US008749127B2

(12) United States Patent
Herring et al.

(10) Patent No.: US 8,749,127 B2
(45) Date of Patent: Jun. 10, 2014

(54) SYSTEM AND MANUFACTURING A CATHODOLUMINESCENT LIGHTING DEVICE

(75) Inventors: Richard Herring, Longmont, CO (US); Charles E. Hunt, Davis, CA (US); Bernard K. Vanch, Beaverton, OR (US); Tomas Hasilik, Olomouc (CZ); Viktor Jelinek, Olomouc (CZ)

(73) Assignee: Vu1 Corporation, New York, NY (US)

( * ) Notice: Subject to any disclaimer, the term of this patent is extended or adjusted under 35 U.S.C. 154(b) by 486 days.

(21) Appl. No.: 13/262,594

(22) PCT Filed: Mar. 30, 2010

(86) PCT No.: PCT/US2010/029142

§ 371 (c)(1),
(2), (4) Date: Feb. 24, 2012

(87) PCT Pub. No.: WO2010/117755

PCT Pub. Date: Oct. 14, 2010

(65) Prior Publication Data

US 2012/0139407 A1 Jun. 7, 2012

Related U.S. Application Data

(60) Provisional application No. 61/164,858, filed on Mar. 30, 2009, provisional application No. 61/164,861, filed on Mar. 30, 2009, provisional application No. 61/164,852, filed on Mar. 30, 2009, provisional application No. 61/164,865, filed on Mar. 30, 2009, provisional application No. 61/164,866, filed on Mar. 30, 2009.

(51) Int. Cl.
*H01J 9/02* (2006.01)

(52) U.S. Cl.
USPC ..... 313/310; 313/496; 313/491; 313/448; 315/1; 315/3; 315/160; 445/34; 445/35

(58) Field of Classification Search
CPC ..... H01J 61/56; H01J 63/06; H01J 9/244; H01J 63/02; H05B 41/14
USPC ..... 313/310, 496, 491, 448, 495; 315/1, 3, 315/160, 169.1, 291; 445/34, 35
See application file for complete search history.

(56) References Cited

U.S. PATENT DOCUMENTS 4,352,043 A * 9/1982 Rigden ..... 315/1
4,818,914 A * 4/1989 Brodie ..... 315/169.3

(Continued)

OTHER PUBLICATIONS

International Search Report and Written Opinion issued in PCT/US2010/029142, dated Nov. 16, 2011, 9 pages.

(Continued)

*Primary Examiner* — Anh Mai
*Assistant Examiner* — Kevin Quarterman
(74) *Attorney, Agent, or Firm* — Lathrop & Gage LLP

(57) ABSTRACT

A device for lighting a room is described. The device has an envelope with a transparent face, the face having an interior surface coated with a cathodoluminescent screen and a thin, reflective, conductive, anode layer. There is a broad-beam electron gun mounted directly to feedthroughs in a base of the envelope with a heated, button-on-hairpin, cathode for emitting electrons in a broad beam towards the anode, and a power supply mounted on the feedthroughs at the base of the envelope that drives the cathode to a multi-kilovolt negative voltage. A two-prong snubber serves as an anode contact to permit the power supply to drive the anode to a voltage near ground. A method of manufacture of the anode uses a single step deposition and lacquering process followed by a metallization using a conical-spiral tungsten filament coated with aluminum by a thermal spray coating process.

44 Claims, 14 Drawing Sheets

(56) References Cited

U.S. PATENT DOCUMENTS

| | | | | |
|---|---|---|---|---|
| 8,035,293 | B2 * | 10/2011 | Popovich | 313/496 |
| 2004/0239253 | A1 | 12/2004 | Walser et al. | |
| 2008/0185953 | A1 | 8/2008 | Hunt et al. | |
| 2008/0185970 | A1 | 8/2008 | Hunt et al. | |
| 2010/0097004 | A1 * | 4/2010 | Herring et al. | 315/246 |

OTHER PUBLICATIONS

International Preliminary Report on Patentability issued in PCT/US2010/029142, dated Oct. 4, 2011, 5 pages.

* cited by examiner

SYSTEM AND MANUFACTURING A CATHODOLUMINESCENT LIGHTING DEVICE

RELATED APPLICATIONS

The present application claims priority to U.S. Provisional Patent Application No. 61/164,861; U.S. Provisional Patent Application No. 61/164,865; U.S. Provisional Patent Application No. 61/164,858; U.S. Provisional Patent Application No. 61/164,866 and U.S. Provisional Patent Application No. 61/164,852, all of which were filed on 30 Mar. 2009, and are hereby incorporated herein by reference.

FIELD

The present application relates to the field of cathodoluminescent light emitting devices, and in particular relates to device structure and methods for manufacturing such devices.

BACKGROUND

It has been known for more than a century that electrons accelerated towards and striking an anode at high energies will cause a cathodoluminescent phosphor on the anode to emit light. When used with tightly focused electron beams and magnetic or electrostatic deflection systems, this method of producing light from phosphors has been widely used in display devices for generations. It has been proposed to use an electron beam to excite phosphors for general room lighting.

There are many differences in detail between the requirements for general room lighting devices and display devices.

A prior anode fabrication method for monochromatic phosphor screens is as follows:

a. An optional transparent electrode layer is applied to a face of a glass envelope.
b. Phosphor slurry is prepared combining phosphor powder (which may contain a blend of luminescent compounds to give emitted light desired spectral characteristics), potassium silicate, water, and small amounts of other chemicals including electrolytes.
c. The slurry is poured into the glass envelope and allowed to settle.
d. After phosphor settles from the slurry, the remaining liquid is removed.
e. Phosphor left on the face of the glass envelope is dried to a solid coating
f. The phosphor is baked to dry and harden the phosphor coating.
g. Water "pre-wet," containing surfactants, is introduced to the envelope and poured out, leaving a slight residue of the pre-wet solution on the rough surface of the phosphor layer and filling tiny cavities thereon.
h. Immediately, a lacquer is applied over the phosphor+pre-wet composite. The lacquer and residual pre-wet is allowed to dry. The result is a smooth surface of lacquer.
i. A thin, conductive, reflective, layer of metal is deposited on the surface of the lacquer; typically this is done by placing a pellet of aluminum on a surface that is then heated by a filament.

Electron guns are commonly used for generating an electron beam for use in Cathode Ray Tubes (CRTs), electron microscopes, x-ray tubes, and other applications. In common use, the electron gun or electron source has electron optics for beam control, typically forming a narrow beam, and in order to stabilize emission. Each electron source has at least one cathode.

In every basic free electron-source lamp, regardless of the type of electron source (thermionic cathode, cold cathode, field-emission cathode), it is required to have an anode contact that allows return of current from the anode. These contacts are typically spring-formed contacts that extend into a glass envelope of the lamp to contact the anode layer.

FIG. 13 shows part of a prior-art cathode ray tube 6 having an electron source 12 and a snubber support tube 10 with independently sprung anode contacts 14 that contact an anode layer 16 within a glass enclosure 8. FIG. 14 shows a front view of snubber tube 10 of FIG. 13 illustrating positions of the three independently sprung contacts 14, as typically used in the industry. Snubber 10 is typically tubular such that contacts 14 are symmetrically attached around the tube. Tube 10 imparts a force to each contact 14 to ensure contact between contacts 14 and anode layer 16.

SUMMARY

A device for lighting a room is described. The device has an envelope with a transparent face, the face having an interior surface coated with a cathodoluminescent screen and a thin, reflective, conductive, anode layer. There is a broad-beam electron gun mounted directly to feedthroughs in a base of the envelope with a heated, button-on-hairpin, cathode for emitting electrons in a broad beam towards the anode, and a power supply mounted on the feedthroughs at the base of the envelope that drives the cathode to a multi-kilovolt negative voltage. A two-prong snubber serves as an anode contact to permit the power supply to drive the anode to a voltage near ground. A method of manufacture of the anode uses a single step deposition and lacquering process followed by a metallization using a conical-spiral tungsten filament coated with aluminum by a thermal spray coating process.

A method of manufacturing an anode for a cathodoluminescent lighting device includes depositing a layer of aluminum on a spiral tungsten filament, inserting the spiral tungsten filament into the envelope under vacuum, preheating the filament to a first temperature, the first temperature above a melting temperature of the aluminum but below a temperature required to significantly evaporate the aluminum, and then rapidly heating the filament to a second temperature, the second temperature above a melting temperature of the aluminum. The filament is held the second temperature for a predetermined time of about one to three seconds, cooled, and removed from the envelope. An oxidizing atmosphere is admitted to heated envelope to burn off excess lacquer. In particular embodiments, the spiral tungsten filament has a conical shape with an apex of the filament closest to the phosphor layer on the face of the envelope on which the anode is being formed. In an embodiment, the filament is coated with aluminum prior to deposition with a thermal-spray coating process.

After the metallization is completed, a multiform assembly having an electron gun and a 2-point contact snubber for contacting the anode are directly mounted within the envelope on one millimeter diameter passthroughs embedded in a glass disk that is then fused into a base of the envelope, and the envelope is evacuated. Also mounted on, and electrically coupled to, the passthroughs, but outside the envelope, is a power supply unit that has a connector for attachment to a lighting fixture. Empty space within the power supply unit and connector is filled with an encapsulant.

DETAILED DESCRIPTION OF THE EMBODIMENTS

It is proposed to take advantage of the glow produced by cathodoluminescent phosphors when struck by electrons for general room lighting. In a general lighting device, a broad, unfocused electron beam may be used in a vacuum device to illuminate a wide anode equipped with a cathodoluminescent screen without need of a deflection system. General lighting devices are, however, quite price-sensitive; it is desirable to prepare the vacuum device, including its anode, at low cost while producing an efficient anode.

Figure 1:
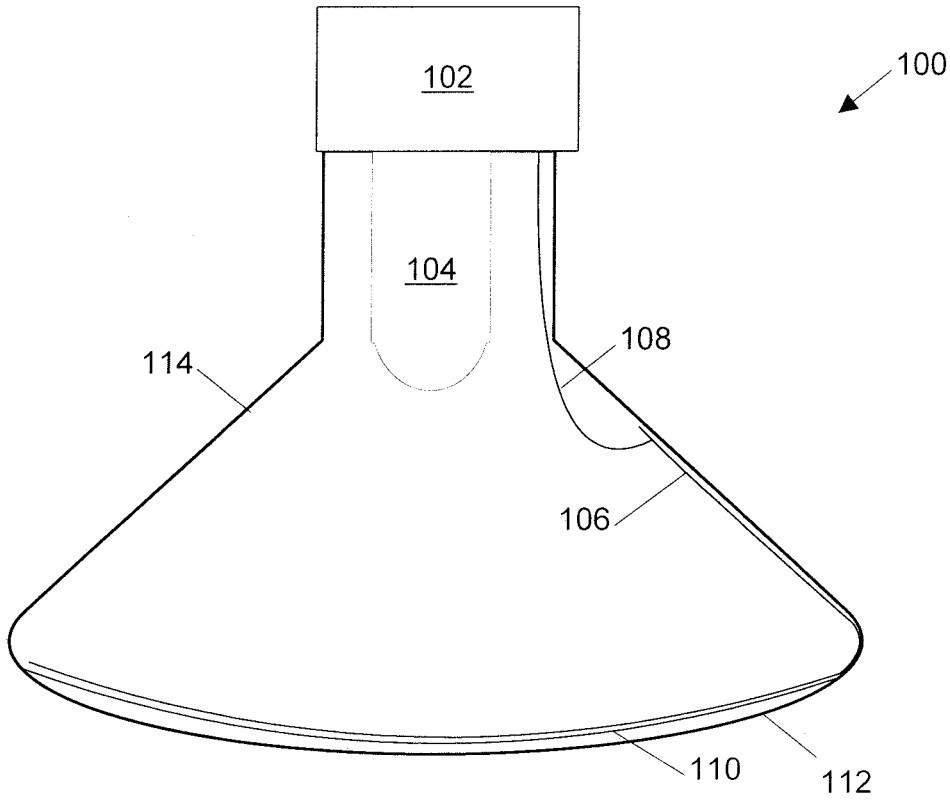
FIG. 1 is a diagram of an embodiment of a cathodoluminescent lighting device.

An exemplary cathodoluminescent light emitting device 100, as illustrated in FIG. 1, has a power supply 102 that provides several voltages for a cathode and other electrodes of a flood-illumination electron gun 104, and for an anode 106. The anode 106 is provided with a voltage strongly positive, on the order of five to twenty kilovolts, relative to the voltage applied to the cathode of electron gun 104. A lead 108 couples the anode voltage to a conductive layer of anode 106. At least a facial portion of anode 106 incorporates a phosphor layer 110 distributed across a face 112 of an envelope 114.

Figure 2:
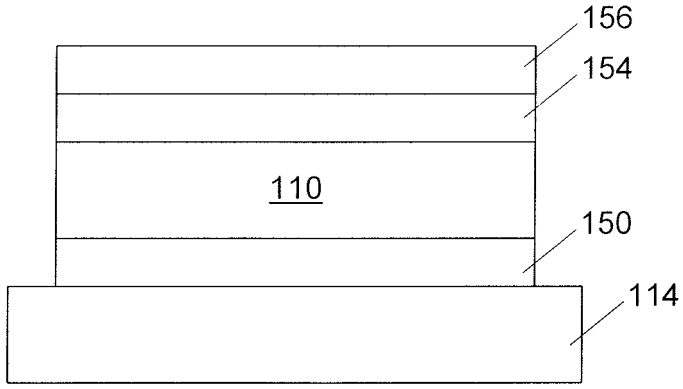
FIG. 2 is a cross sectional diagram of an anode structure for use in the cathodoluminescent lighting device of FIG. 1.

A desired construction of the facial portion of anode 106 may in some embodiments have an optional transparent conductive layer 150 (FIG. 2) deposited on glass envelope 114. Deposited over transparent conductive layer 150 or in other embodiments directly on the envelope is a phosphor layer 110, a layer of lacquer 154 that serves to level irregularities in phosphor layer 110, and, deposited over and initially adherent to lacquer 154, a thin conductive layer 156 of reflective metal such as aluminum. By leveling out irregularities in phosphor layer 110, lacquer layer 154 helps to produce a smooth conductive layer 156 with good reflectivity.

Figure 3:
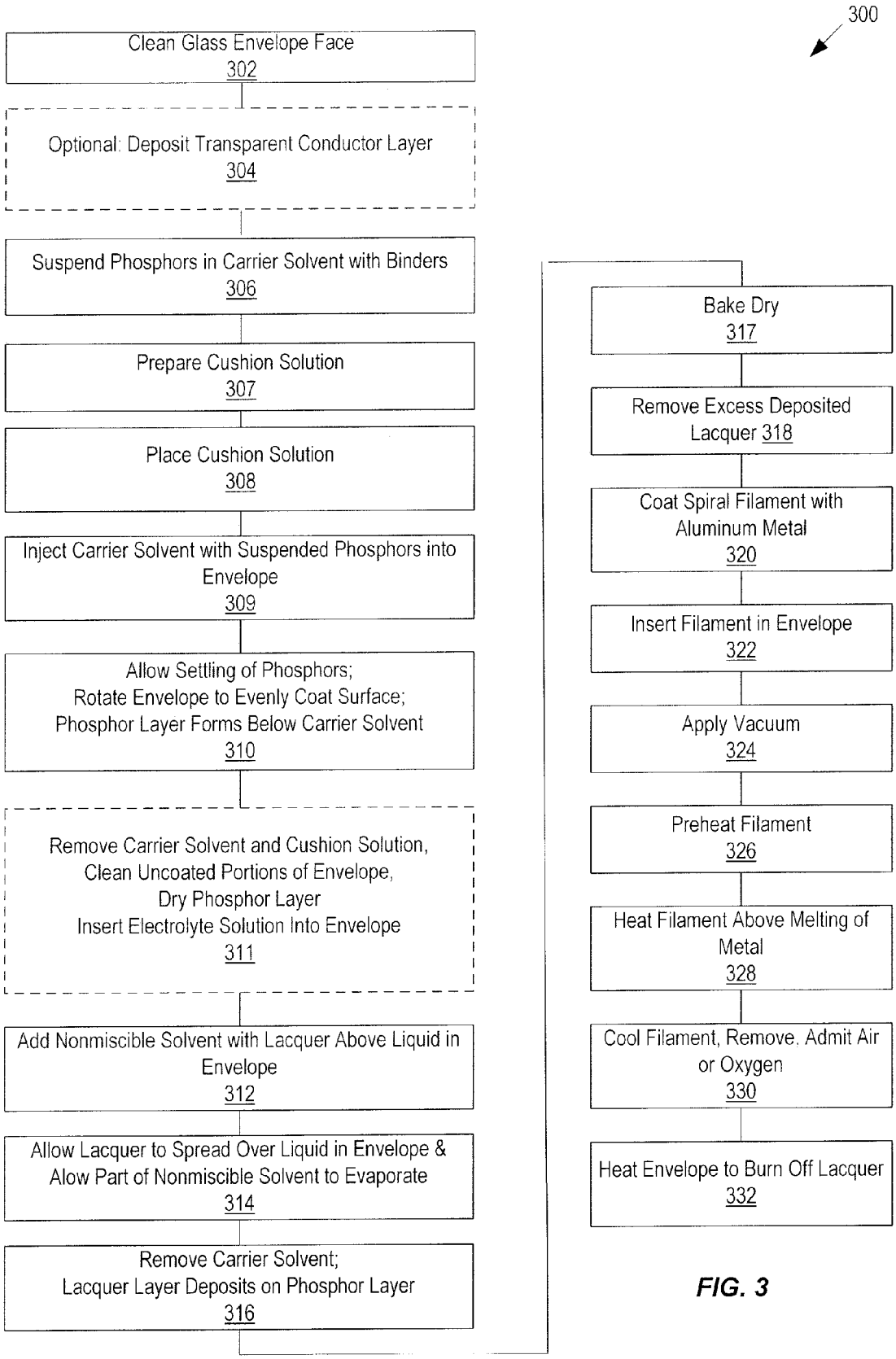
FIG. 3 is a flowchart of a method for manufacture of the anode structure of FIG. 2.

FIG. 3 illustrates an improved method 300 of forming anode 106. Method 300 begins with chemically cleaning the interior, including face 112, of glass envelope 114, in step 302. A phosphor slurry is prepared, in step 306. The slurry includes a carrier solvent, a fine powder of phosphor suspended in the carrier solvent, as well as well as binding agents such as potassium silicate that serve to attach the phosphor to the envelope 114. The carrier solvent is typically water-based. In an embodiment, the carrier solvent is water, and binders include potassium silicate solution.

A cushion solution is prepared in step 307, by dissolving one gram of barium acetate in water. A portion of cushion solution is placed into the envelope, in step 308. A smaller portion of slurry is then injected into the envelope on the cushion solution, in step 309. Phosphor particles are allowed to settle, in step 310. For example, phosphor particles are allowed to settle onto face 112 of envelope 114 while envelope 114 is gently tilted and rotated to encourage formation of a phosphor layer 110 of nearly uniform thickness on face 112. In an embodiment, 150 milliliters of cushion solution and seventeen milliliters of phosphor slurry are used for each envelope, and twelve minutes are allowed for settlement. Rotation of the envelope is then stopped.

A lacquer is prepared as a solution of a film-forming organic lacquer or polymer compound in an organic solvent that is immiscible in the slurry carrier solvent and cushion solution. In an alternative embodiment that ues an electrolyte solution, the organic solvent is immiscible in the electrolyte solution. The lacquer solution has a specific gravity lighter than the carrier solvent, cushion solution, or electrolyte solution. In an embodiment, the lacquer has a three to five percent solid content of nitrocellulose or an acrylic lacquer dissolved in a solvent comprising ethyl acetate and other organic solvents.

In an embodiment, lacquer is applied directly over the cushion solution in the envelope. In an alternative embodiment that makes use of an electrolyte solution, lacquer is applied over the electrolyte solution. In either embodiment, lacquer is applied over an underlying liquid in the envelope.

In the alternative embodiment using an electrolyte solution, the liquid in the envelope, including remaining cushion solution and carrier solvent, is removed 311. Those portions of the envelope for which phosphor coating is not desired are cleaned with deionized water, the phosphor coating is dried, and an aliquot of the electrolyte solution is added to the envelope.

An aliquot of the prepared lacquer is then added on top of, or floated on, the underlying liquid in the envelope, in step 312. Since the lacquer solvent has specific gravity less than that of the underlying liquid in envelope 114, the lacquer floats on the liquid. In an embodiment, the aliquot of prepared lacquer ranges from 0.3 to 0.5 milliliter.

Figure 4:
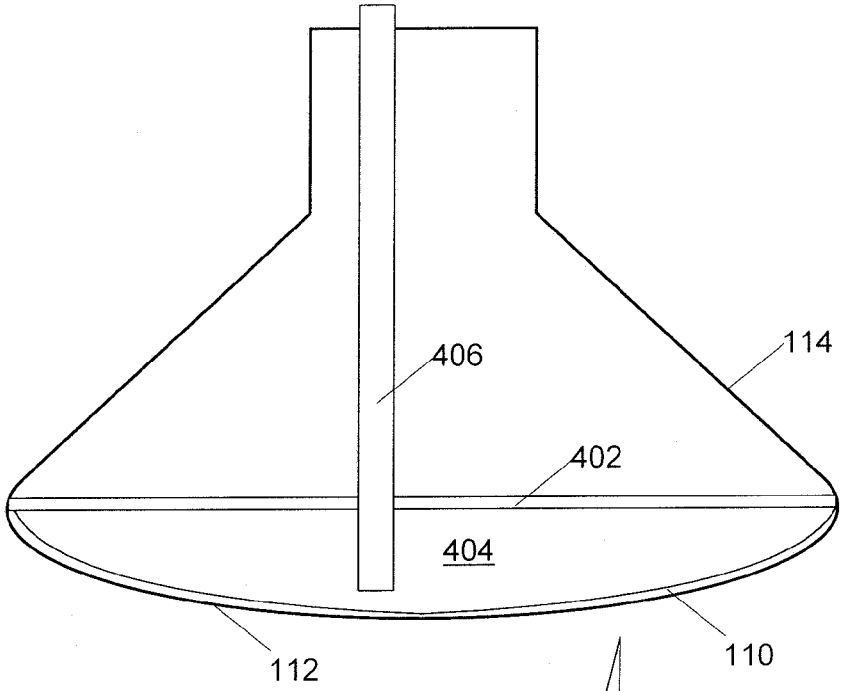
FIG. 4 illustrates suctioning of the carrier solvent to allow the lacquer layer to settle on the phosphor layer.

The prepared lacquer is allowed to spread over the carrier solvent and at least a portion of the volatile organic lacquer solvent is allowed to evaporate, in step 314. This allows the lacquer or polymer content of the lacquer solution to form a smooth, and at least partially solidified, film 402 (FIG. 4) of lacquer over carrier solvent 404 and deposited phosphor layer 110 on face 112 of envelope 114.

In an embodiment, envelope 114 is gently rotated to an inverted position. During this rotation, gravity causes the underlying liquid 404 (the underlying liquid being carrier solvent and cushion solution, or electrolyte solution), 404 to burst through lacquer film 402 at a lower edge, and underlying liquid 404 then pours out of envelope 114. As carrier solvent 404 pours out, lacquer film 402 rises to settle onto phosphor layer 110.

Figure 5:
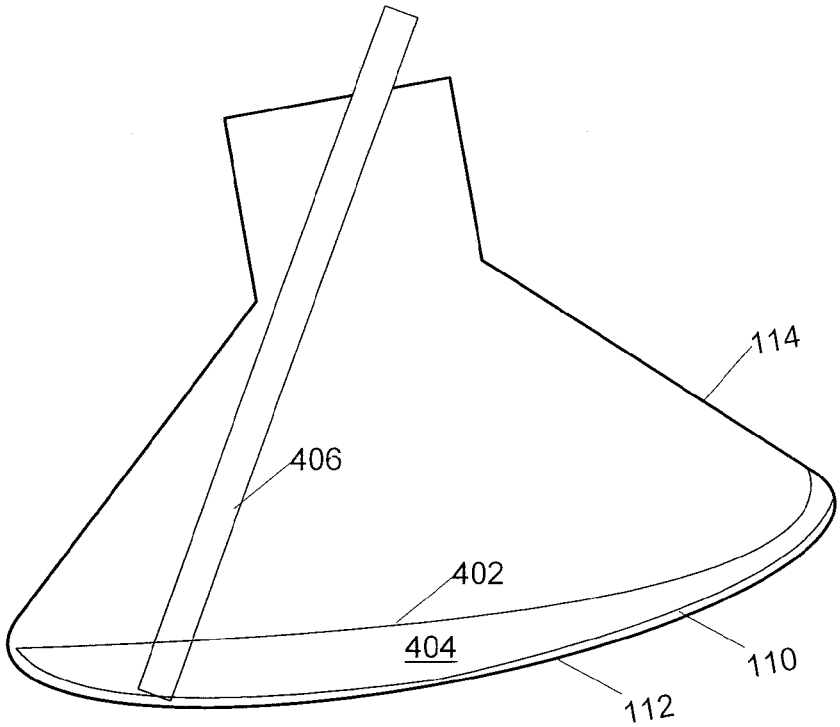
FIG. 5 represents an alternative view of suctioning the carrier solvent to allow the lacquer layer to settle on the phosphor layer.

In an alternative embodiment, a probe 406 is introduced to envelope 114, extending below lacquer film 402. Underlying liquid 404 is carefully suctioned or siphoned to remove underlying liquid 404 in step 316. In embodiments using suctioning, envelope 114 may be tipped, as illustrated in FIG. 5, during suctioning to avoid probe 406 marking a center of lacquer film 402. Lacquer film 402 stretches to match the curvature of face 112 and settles onto phosphor layer 110 as the underlying liquid 404 is removed. A thin residual portion of underlying liquid 404 may remain in the envelope at the end of suctioning; this portion serves some of the functions of a traditional pre-wet.

The resulting structure of phosphor coated by lacquer is then baked dry at a temperature of less than 100 Celsius, in step 317. Baking drives out remaining lacquer solvent from the lacquer film. Further, baking helps evaporate the remaining carrier solvent 404 and cushion solution through lacquer film 402. After baking, the resulting structure has a final lacquer layer 154 (FIG. 2) lying on phosphor layer 110, with remaining carrier and lacquer solvents evaporated. Baking also hardens the potassium silicate binder of phosphor layer 110 into silica that binds phosphor particles into phosphor layer 110 and firmly adheres phosphor layer 110 to envelope 114. At this point, a cross section of the coated face would show the glass of envelope face 112 as a substrate, phosphor layer 110 of phosphor particles bound to the glass with hardened silica from the potassium silicate and having a microscopically rough surface, and a layer of lacquer 154 adherent to high points of phosphor layer 110 and tenting over low points of the microscopically rough surface of phosphor layer 110.

Excess lacquer is then removed, in step 318, for example by mechanically wiping the interior of the envelope at locations where a phosphor screen is not desired.

In some alternative embodiments, an optional transparent conductor layer is deposited on face 112 of envelope 114 after cleaning and before placing the slurry in envelope 114 (step 308) as shown in optional step 304.

It has been found that a thin and uniform metal coating over lacquer layer 402 at face 112 of envelope 114 is desirable for efficient operation of the lighting device. It has been found that achieving a uniform metal coating requires care. Uniformity of the coating layer is sensitive to deposition filament shape as well as a method of applying metal to be deposited to the deposition filament.

Figure 7:
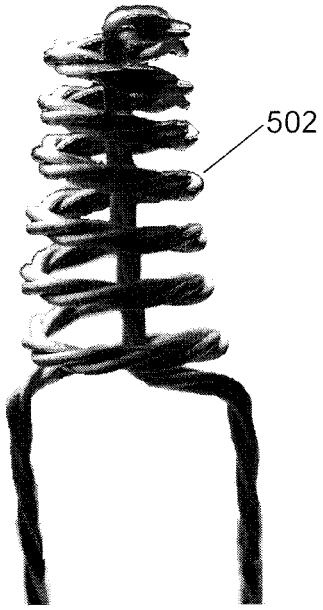
FIG. 7 is an illustration of a portion of a filament for metallization illustrating a nonuniform pitch of winding used to ensure even coating of the faceplate of the device.

FIG. 7 illustrates a coiled tungsten deposition filament 502. In an embodiment the filament is made of three strands twisted together of tungsten wire and having overall diameter of six-tenths millimeter diameter. The filament is formed into a conical spiral. Other embodiments may have overall diameters between four tenths and eight tenths millimeters and may have other counts of strands.

In an embodiment, the narrow end, or apex, of the spiral is approximately five millimeters in diameter, and an angle 504 between an axis of the spiral and the sides of the spiral is between five and forty-five degrees, and preferably approximately ten degrees. The apex of filament 502 is fed through an axial branch 505 of filament 502. In an embodiment, the spiral portion of filament 502 is approximately sixteen millimeters long and has a winding pitch of two millimeters.

Figure 6:
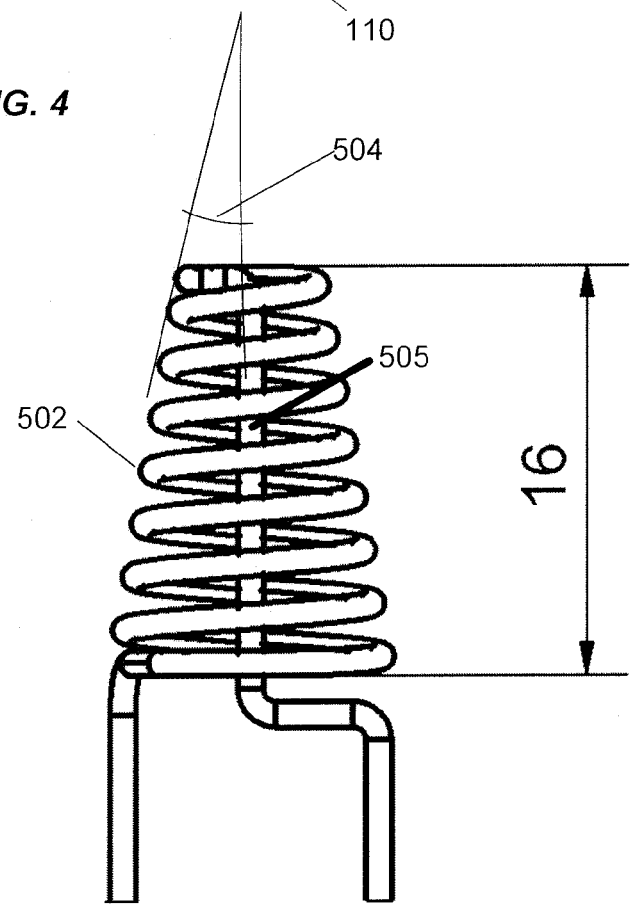
FIG. 6 is a sketch of a portion of a filament for metallization illustrating the truncated conical winding used to ensure even coating of the faceplate of the device.
Figure 8:
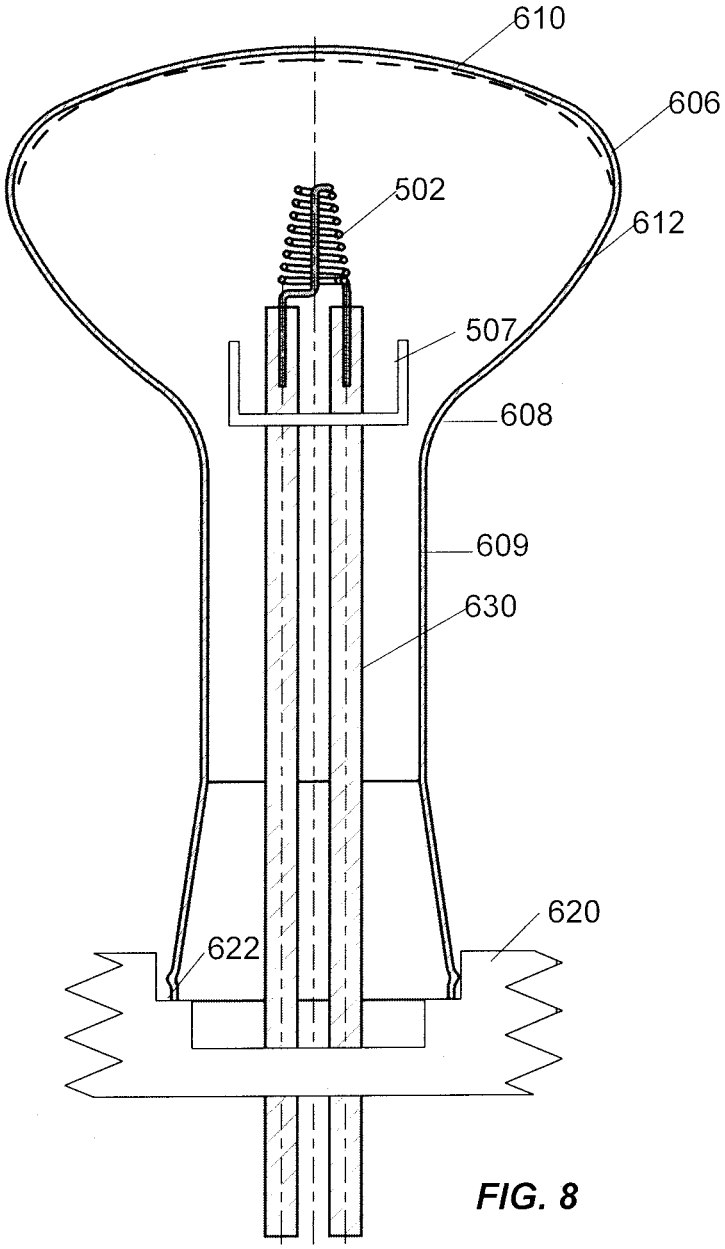
FIG. 8 is a lateral cross section view of a filament for metallization illustrating conical shape of the filament to ensure even coating of the faceplate of the device.

In a particular embodiment, the spiral is coiled more tightly at a center-apex of filament 502, as illustrated in FIG. 6, with an apical pitch of two millimeters, a basal pitch of four millimeters, the pitch increasing linearly along filament 502. The non-uniform pitch of filament windings, and the conical spiral of filament 502, together provide for an even flux of aluminum vapor over the lacquer and phosphor coating on a domed face 610 of an envelope 606, and thereby allow for an even coating of face 610 (see FIG. 8). It is desirable to coat face 610 of envelope 606 with the aluminum such that the thickness of aluminum varies by no more than ten percent across face 610 of envelope 606, although greater variations are allowed along sides 612 and a neck 608 of envelope 606.

Filament 502 is equipped with a masking cup 507 that obstructs line of sight from filament 502 to those portions of envelope 606, primarily in lower neck 609 of envelope 606, on which aluminum conductive coating is not desired. Filament 502 is mounted to a pair of buss-bars 630 that are capable of carrying the high current used for coating face 610.

Returning to method 300 (FIG. 3), filament 502 is coated with conductive metal, in step 320. In an embodiment, about eight to twelve milligrams of a conductive metal that evaporates at relatively low temperatures, such as aluminum metal, is applied as a coating to filament 502. In other embodiments, different amounts of metal may be used; for example, greater amounts of conductive metal may be appropriate for larger envelopes. In an embodiment, the conductive metal is aluminum and is applied to filament 502 by a thermal-spray aluminum-coating process performed under non-oxidizing or reducing atmosphere. In a particular embodiment, fine aluminum metal wire is fed into, and melted by, an electric arc. The melted aluminum is atomized to droplets and directed to filament 502 from the arc by a rapidly flowing non-oxidizing gas, such as nitrogen gas. Upon striking the filament the molten aluminum droplets coat filament 502 with a thin coating of aluminum. In an alternative embodiment, the fine aluminum metal wire is melted and sprayed by hot, reducing, gas from a torch flame.

In an alternative embodiment, the conductive metal is aluminum and is applied to filament 502 by draping a thin aluminum foil over filament 502, and then heating filament 502 to at least 680 Celsius under non-oxidizing atmosphere to melt some of the foil such that resulting melted aluminum adheres to filament 502.

In an alternative embodiment filament 502 is coated with aluminum by dipping filament 502 into molten aluminum. This method may, however, be difficult to control. In yet another alternative embodiment, filament 502 is coated with aluminum by dusting or painting filament 502 with material comprising a finely-ground aluminum powder.

Coated metal filament 502 on its buss-bar support 630 is inserted into envelope 606, in step 322. Envelope 606 has already been coated with phosphor and lacquer layers as previously described. In an embodiment, insertion is achieved by inverting envelope 606 and placing it over filament 502. A vacuum is applied to envelope 606 and filament 502 in step 324, so as to avoid oxidation of the aluminum during evaporation. In an embodiment, the apical tip of filament 502 is between two and six, and preferably about four, centimeters from the phosphor and lacquer layers Once the vacuum is applied, filament 502 is preheated, in step 326. Filament 502 is for example heated to a temperature close to and slightly above the six hundred sixty degree Celsius melting point of the aluminum with which it has been coated. The preheat temperature is selected to be low enough that the vapor pressure of aluminum is quite low, and little evaporation occurs. The preheat temperature is high enough that the aluminum wets the surface of the filament.

Filament 502 is then heated to a temperature above the melting point of the coating metal (i.e., aluminum), in step 328. In one example, filament 502 is brought rapidly to a temperature of substantially above the preheat temperature and well above six hundred sixty Celsius to evaporate the aluminum and coat the envelope, lacquer, and phosphor within about one to three seconds. This may be achieved by an electric current of approximately one hundred sixty amperes maximum. Other embodiments having other filament diameters may use other current levels. Once the aluminum is evaporated, condensing to form a coating on the lacquer and phosphor, filament 502 is cooled and removed from the envelope, and air or oxygen is admitted, in step 330. Envelope 606 is heated to approximately 450 degrees Celsius in an oxidizing environment, such as air or oxygen, to char and thereby burn off the lacquer, leaving a final structure of a smooth-surfaced reflective metal film adherent over the somewhat rougher phosphor layer.

In an embodiment, for operation with a cathode-anode voltage of approximately fifteen to sixteen thousand volts, the aluminum coating over the phosphor is preferably in the range of approximately sixty to ninety nanometers thick. The resulting aluminum coating is in contact with, and adherent to, phosphor particles and silica binder at high points of the microscopically-rough phosphor layer, while tenting over low points of the phosphor layer.

In an embodiment of method 300, a rack 620 (FIG. 8) having sixteen filaments mounted on suitable ceramic holders is used; the rack has wiring suitable for coupling the filaments to a source of electrical power. A single-envelope portion of rack 620 is illustrated in FIG. 6. Rack 620 is placed in a nitrogen environment and all sixteen filaments are given a thermal spray coating of aluminum as heretofore described. An envelope is inverted and placed over each filament, such that the neck of each envelope fits into a recess 622 in rack 620 and is thereby stabilized during evaporation. Rack 620 is then transferred into a sealable chamber, the chamber is evacuated, all sixteen filaments are preheated, and aluminum is flash-evaporated from all sixteen filaments onto the lacquer layers of all sixteen envelopes simultaneously as heretofore described.

The envelope is then transferred to an oxidizing atmosphere and heated; the lacquer layer oxidizes and disappears; a step known as burning off the lacquer.

Once the lacquer has been burned off, the envelope, with phosphor coating and metallization is ready for a base assembly having an anode contact and a cathode 700 to be inserted into it; the glass base of the base assembly is fused with the edges of the envelope with vacuum applied, thereby completing assembly of the bulb portion of the light emitting device.

Figure 9:
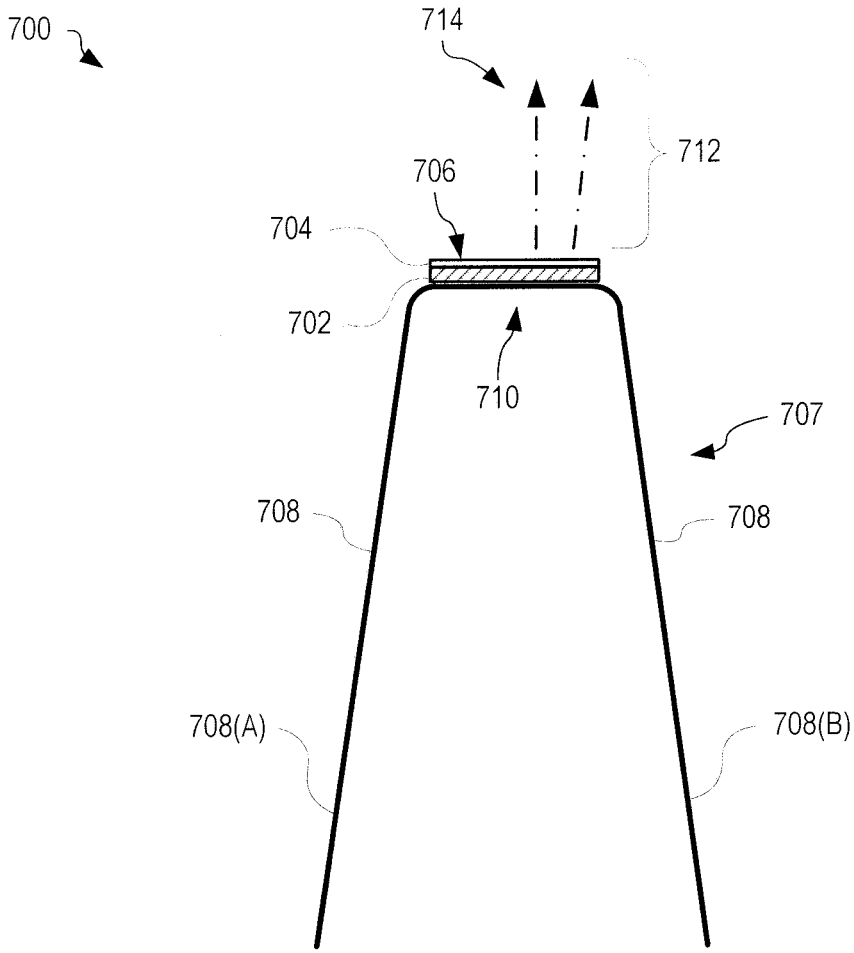
FIG. 9 shows one exemplary thermionic flood-emission cathode, in an embodiment.
Figure 10:
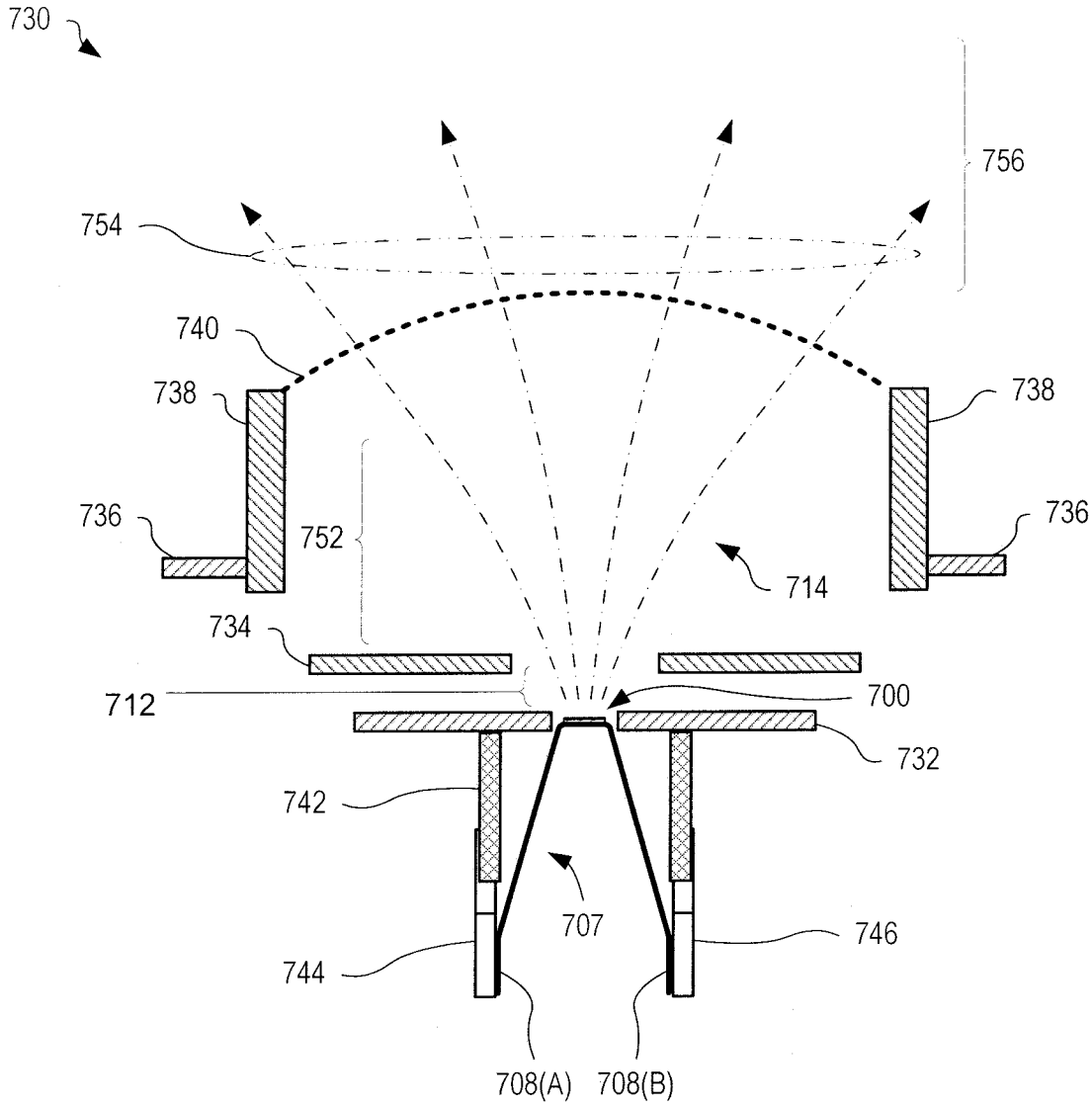
FIG. 10 shows the thermionic flood-emission cathode of FIG. 9 within an exemplary multiform assembly, in an embodiment.

The base assembly has a cathode 700 as illustrated in FIG. 9, in a multiform assembly 730 as illustrated in FIG. 10 that serves as a broad-beam electron gun.

FIG. 9 shows an exemplary thermionic flood-emission cathode 700 for lighting applications, forming part of the electron source or multiform assembly of FIG. 10. In one embodiment, cathode 700 has a Nickel (Ni) disk substrate 702, on which is formed an emissive material 704 to provide an emissive surface 706. Emissive material 704 is, for example, Barium Oxide (BaO); however, other emissive materials may be used without departing from the scope hereof. A disk or alternatively-shaped substrate coated with other thermionically-emissive cathode materials as known in the arts of vacuum tube cathodes and cathode ray tubes may be used without departing from the scope hereof.

A tungsten, or tungsten alloy, wire 708 is bent to form an inverted 'U' shape with a flat bottom 710 to provide a heating element 707. Substrate 702 is attached electrically and mechanically to wire 708 at flat bottom 710. For example, substrate 702 is attached to wire 708 using one of resistance spot welding, laser welding, brazing, or other attachment processes known in the art. Tungsten wire 708 incandesces and directly heats substrate 702 and emissive material 704. In this example, substrate 702 and tungsten wire 708 are also electrically connected. In another embodiment, a simple incandescing tungsten wire having a coating of emissive material, but with no cathode substrate attached, is used for electron emission. Materials other than tungsten may be used and formed other than as wire, without departing from the scope hereof. For example, other resistive materials having suitable high-temperature mechanical strength may be adapted for heating substrate 702 and emissive material 704, and may be formed as wire, plate, ribbon, tape, bar, or any other physical configuration.

Emissive material 704 is for example formed by applying a "Triple Carbonate" (predominantly a Barium Carbonate mixture) to substrate 702. The Triple Carbonate is converted, under vacuum, to a BaO layer. Emissive material is carefully patterned onto substrate 702 in order to maximize uniformity, and thereby does not require the use of additional electron-optics to achieve uniformity.

A current is passed through tungsten wire 708 (i.e., by applying a voltage differential between wire 708(A) and wire 708(B)) such that substrate 702 and emissive material 704 are directly heated from wire 708. The current through tungsten wire 708 may be a direct current (DC), an alternating current (AC), or a pulsed current.

By having substrate 702 in direct intimate contact with wire 708, cost and complexity are minimized and a quick start-up time of the associated light emitting device is realized. Thus, the lamp may appear to turn on 'instantly'.

In one example of operation, substrate 702 and its coating of emissive material 704 are heated to 900 C by tungsten wire 708, and an electric field 712 is created proximate emissive surface 706. Electrons, shown as arrows 714, emitted from emissive surface 706 result in a total cathode emitter current of approximately 1 mA. The total cathode emitter current may be within a range of between 0.1 mA and 5 mA without departing from the scope hereof. Emitted electrons are allowed to spread, without any focus, into a flood beam having diameter of approximately 100 mm when it strikes a cathodoluminescent phosphor (e.g., phosphor layer 776, FIG. 11) within a light emitting device in which it is installed. The use of a low (e.g., 1 mA) emitter current allows thermionic flood-emission cathode 700 to operate at a lower temperature (e.g., 900 C) and thereby maximize operational lifetime of cathode 700.

Figure 12:
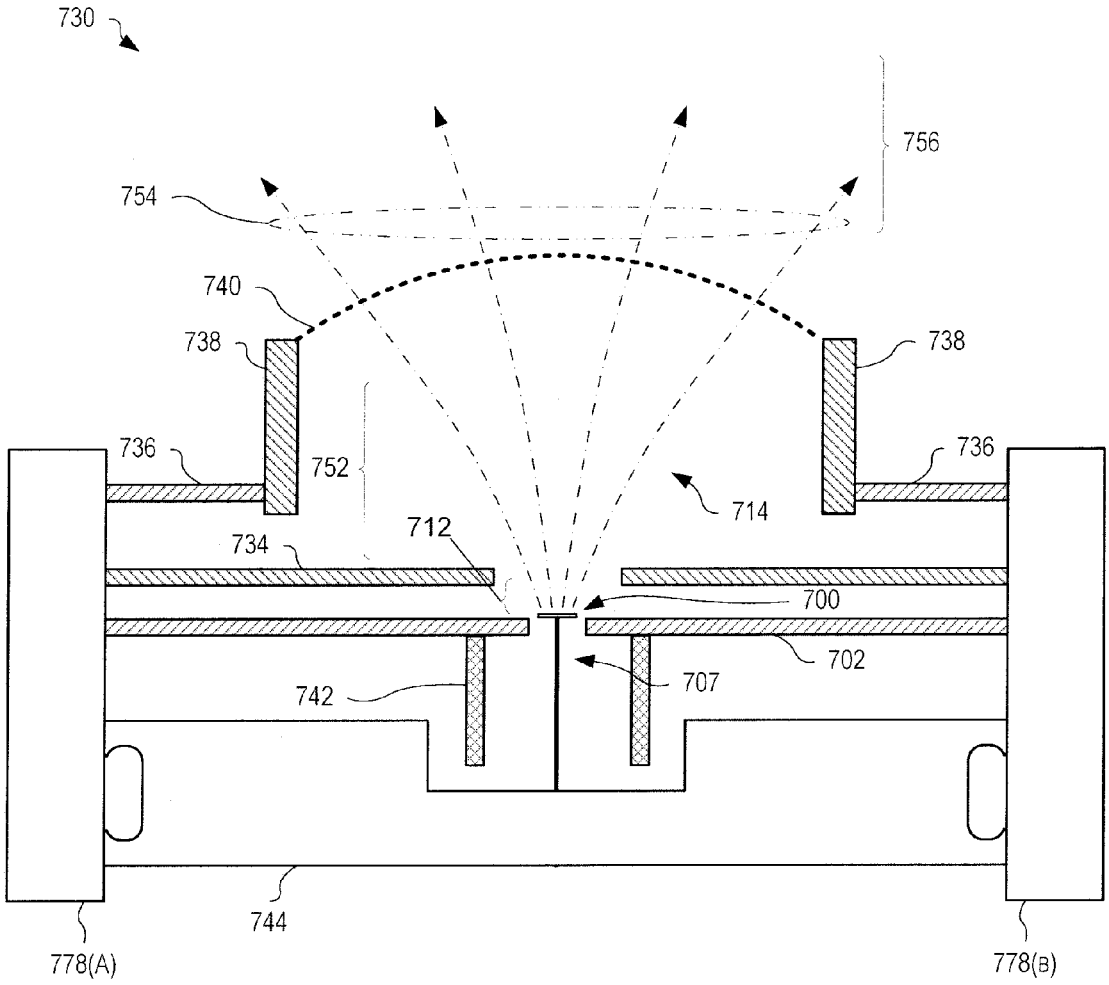
FIG. 12 shows a side view of the multiform assembly of FIG. 10, in an embodiment.
Figure 13:
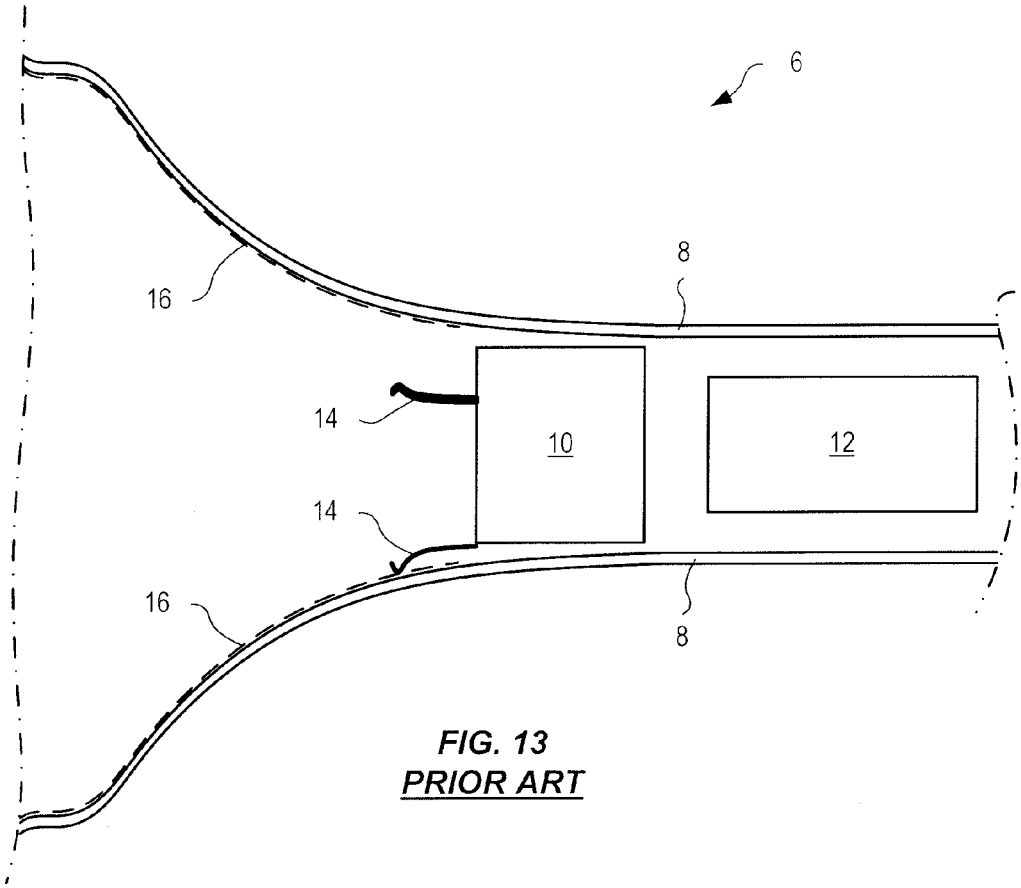
FIG. 13 PRIOR ART
FIG. 13 shows part of a prior-art cathode ray tube having an electron source and a snubber with independently sprung anode contacts that contact an anode layer within a glass enclosure.
Figure 14:
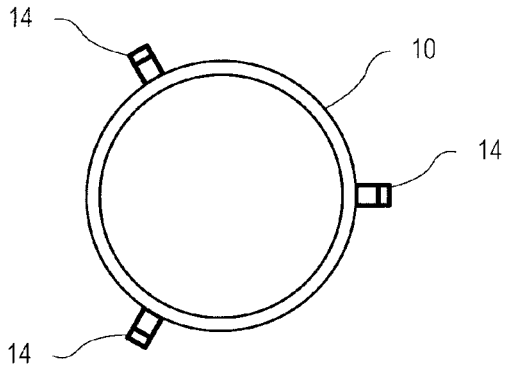
FIG. 14 PRIOR ART
FIG. 14 shows the prior-art snubber of FIG. 13 with three independently sprung contacts.

FIG. 10 shows thermionic flood-emission cathode 700 of FIG. 9 within an exemplary multiform assembly 730, that includes a metal suppressor or guard ring 732, a metal extraction ring 734, a metal field-forming ring 736, a metal support ring 738, and a metal diffusing grid 740 (e.g., a metal cloth mesh). FIG. 12 shows a side view of the multiform assembly 730 of FIG. 10. Assembly 730 is adapted to high-volume manufacture by being constructed of parts that are formed into a single unit prior to installation within a light emitting device. FIGS. 10 and 12 are best viewed together with the following description.

A first metal heater bar 744 attaches to a wire portion 708(A) of heating element 737 and a second metal heater bar 746 attaches to a wire portion 708(B) of heating element 737. Attachment of wire portions 708(A) and 708(B) is by one of resistance spot welding, laser welding, brazing, or other known methods of connecting. Metal of components 732, 734, 736, 738, 740, 744 and 746 may be one of more of stainless steel, molybdenum and nickel, Inconel® and other materials having similar properties.

Metal guard ring 732 is held at substantially the same potential as, or at a more negative potential than, cathode 700. Metal guard ring 732 shields the sides of cathode 700 from undesired electrical fields. Metal extraction ring 734 is held at a potential higher than that of cathode 700 to form an electric field 712 that causes electrons to be emitted from emissive surface 706 of cathode 700 (see FIG. 9) and accelerated away therefrom. Metal field-forming ring 736 has a potential equal to or higher than metal extraction ring 734 and creates an electric field 752 that spreads (i.e., diffuses) the electrons emitted from cathode 700 to a flood configuration for use within a light emitting device (e.g., light emitting device 400, FIG. 12). Metal support ring 738 attaches to metal field-forming ring 736 and supports metal diffusing grid 740, which has the same potential as metal field-forming ring 736 and metal support ring 738. Metal diffusing grid 740 shapes electric field 752 such that electrons 714 emitted from cathode 700 form a uniform and properly patterned electron beam 754. Electrons 714 are transmitted through metal diffusing grid 740 with minimal interception or secondary electron formation. A third electric field 756 accelerates electrons 714 towards an anode (see anode 774, FIG. 11), not shown in FIG. 10, and is generated by applying a potential to the anode that is greater than the potential of metal diffusing grid 740.

Figure 11:
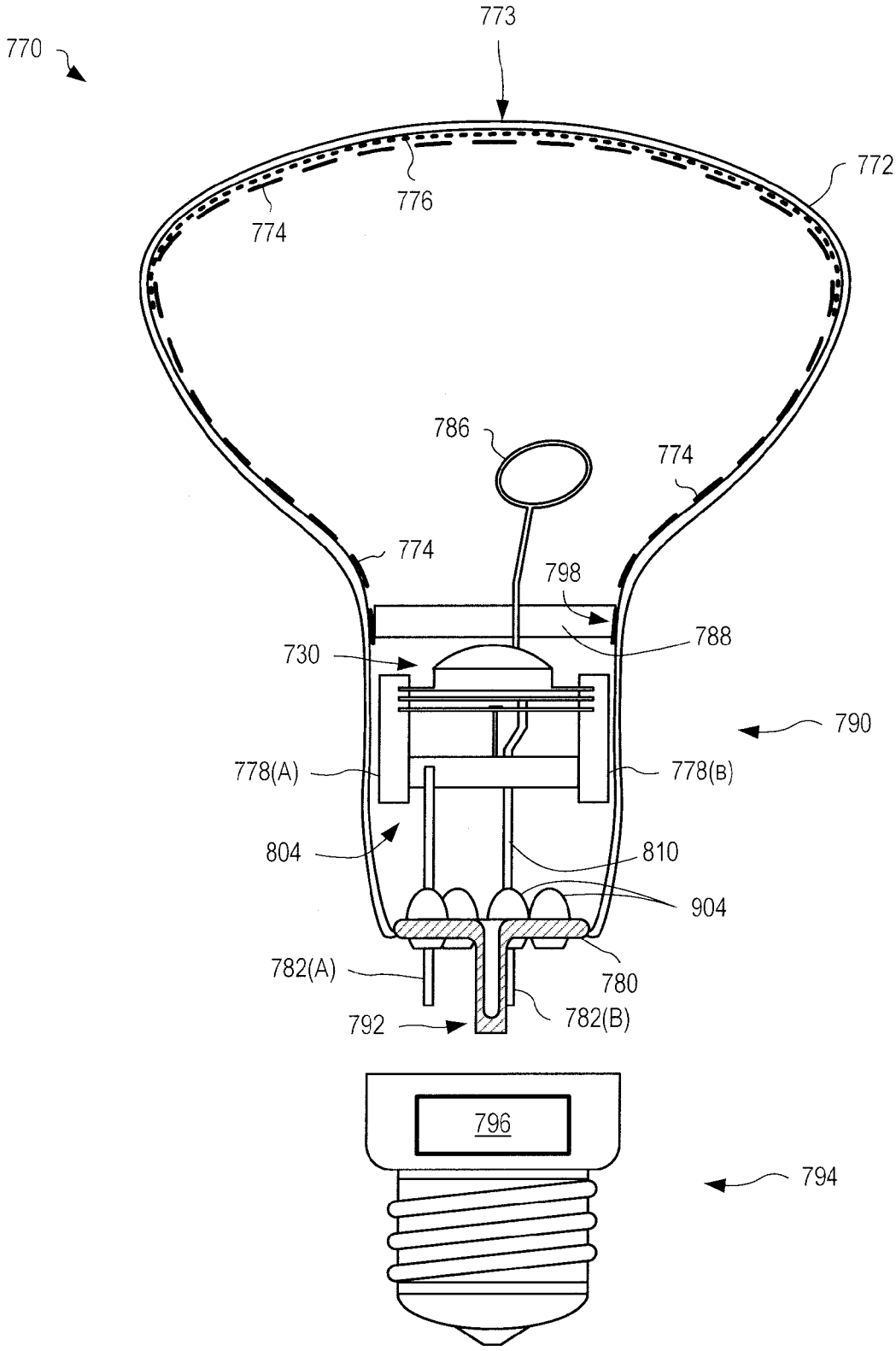
FIG. 11 shows one exemplary light emitting device incorporating the multiform assembly of FIG. 10, in an embodiment.

Metal components 732, 734, 736 and 744 are secured in position by two opposed dielectric attachment bars (not shown in FIG. 10, see dielectric attachment bars 778(A) and 778(B) of FIG. 11) to form multiform assembly 730. Dielectric attachment bars 778(A) and 778(B) may be made of ceramic or glass. However, other dielectric materials, such as mica, may be used without departing from the scope hereof.

Assembly 730 functions as an electron source within a light emitting device. Optionally, metal guard ring 732 may be omitted where greater precision is used in forming emissive material 704 on substrate 702. Further, metal components may also be made three dimensional in order to minimize size, for example. Three dimensional shaping of components may also be used to optimize electric field confinement. Metal components 732, 734, 736 and 744 (both flat and three dimensional) may be manufactured inexpensively from sheet metal using a stamping technology.

FIG. 11 shows one exemplary light emitting device 770 incorporating the multiform assembly 730 of FIG. 10. Lighting device 770 includes a transparent envelope 772 and a base section 794. Transparent envelope 772 is for example glass.

Envelope 772 has a face portion 773 through which light is emitted during operation of light emitting device 770 when used to form a light emitting device (e.g., light emitting device 400, FIG. 12). An inner surface of face portion 773 of envelope 772 is coated with a phosphor layer 776. Envelope 772 has a feedthrough base 780 that is formed with a plurality of electrical conductors 782 (only conductors 782(A) and 782(B) are shown for clarity of illustration) that pass from the inside to the outside of envelope 772. Multiform assembly 730 attaches to internal ends of conductors 782 of feedthrough base 780 such that conductors 782 support assembly 730. For example, conductor 782(A) is shown attached to and supporting heater bar 744, and conductor 782(B) is shown attached to and supporting an optional getter ring 786. A metal extracting ring 734 is positioned to guide and impel electrons emitted by cathode 700 towards anode 774. Since assembly 730 is connected together by dielectric attachment bars 778, assembly 730 is fully supported by conductors 782. In one example, conductors 782 are approximately 1 mm in diameter. Feedthrough base 780 may be formed together with multiform assembly 730 prior to forming envelope 772. Assembly 730 also includes an anode connector spring 788 that electrically contacts a mirror anode 774 formed within envelope 772 over phosphor layer 776 and towards a neck 790 of envelope 772. Each of spring 788, cathode 700, metal guard ring 732, metal extraction ring 734 and metal field-forming ring 736 may connect to conductors 782 such that potentials of anode 774, cathode 700, metal guard ring 732, metal extraction ring 734 and metal field-forming ring 736 may be controlled. Optionally, getter ring 786 is formed to support a getter material within envelope 772 and connects to one or more of conductors 782 to allow activation. Shapes other than the illustrated ring may be used for the getter without departing from the scope hereof.

Base section 794 provides electrical connectivity (shown as an Edison thread in this example) to an external source of electricity and may include one or more power converters 796 (and/or other electronic circuitry) for supplying appropriate potentials to spring 788, cathode 700, metal guard ring 732, metal extraction ring 734, and metal field-forming ring 736, and thereby operating light emitting device 770 to produce light.

Figure 15:
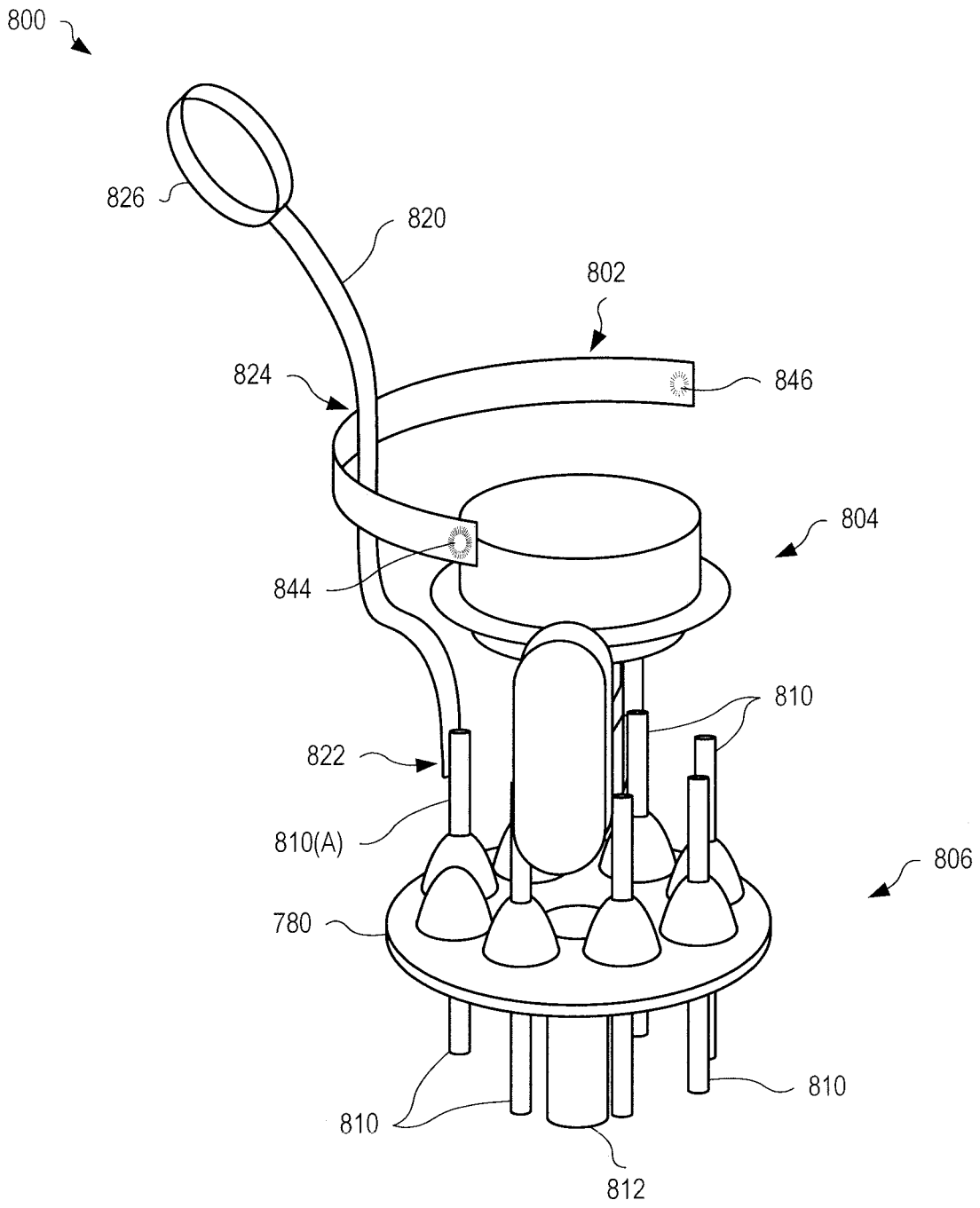
FIG. 15 shows a two-point sprung anode contact as part of the multiform assembly attached to a base portion of a light emitting device, according to an embodiment.
Figure 16:
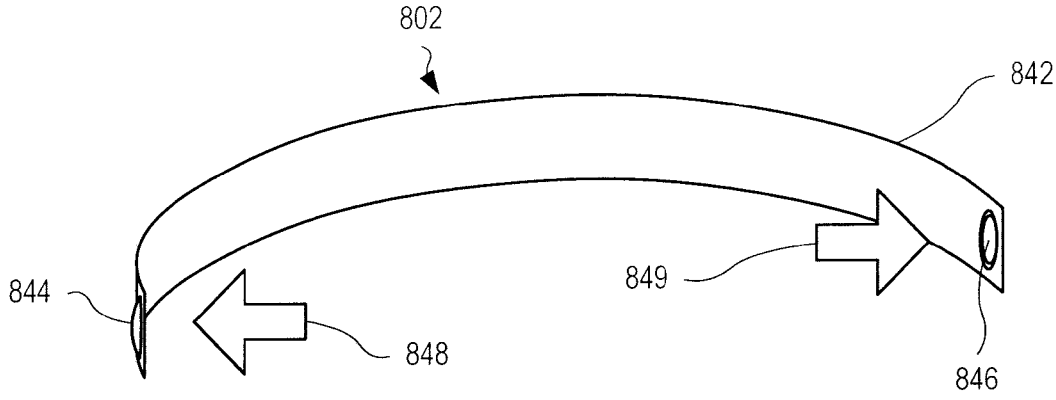
FIGS. 16 and 17 show two-point sprung anode contact of FIG. 15 in further detail.
Figure 17:
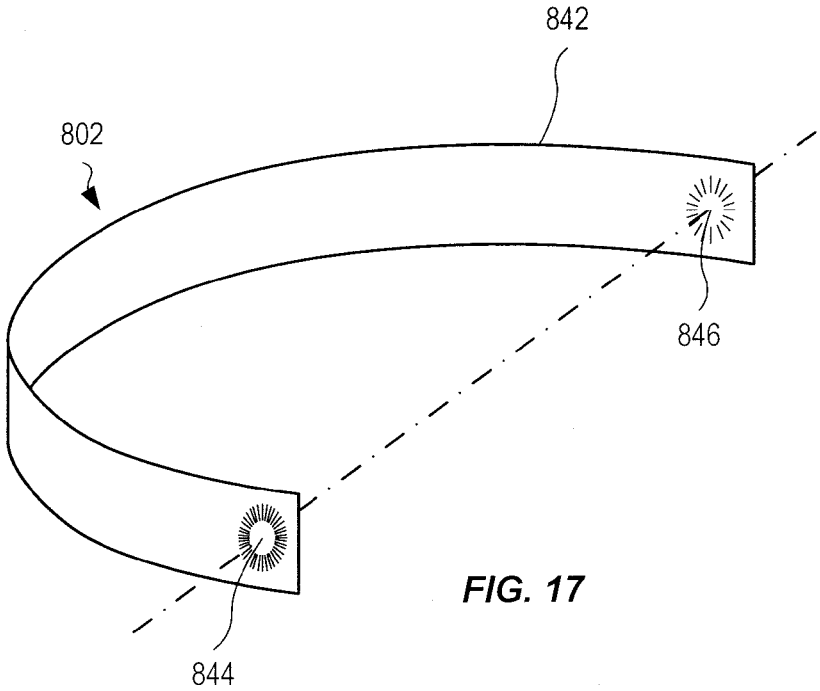

FIG. 15 shows one exemplary two-point sprung anode contact 802 as part of a multi-form assembly 800 that includes a thermionic cathode assembly 804 attached to a base portion 806 as used in a light emitting device (e.g., light emitting device 770 of FIG. 11). Base portion 806 is formed of a glass base 780 with a plurality of metal feedthrough conductors 810 and an evacuation tube 812. In this example, thermionic cathode assembly 804 attaches directly to two or more conductors 810 that provide electrical connectivity to, and mechanical support for, assembly 804. A shaped rod 820 attaches to a certain feedthrough conductor 810(A) at a point 822 and to two-point sprung anode contact 802 at point 824. Conductor 810(A) and rod 820 provide electrical connectivity and mechanical support for two-point sprung anode contact 802. Optionally, rod 820 may also support a getter ring 826 such that getter material is disposed away from electron flight of thermionic cathode assembly 804; where no getter ring 826 is required, rod 820 may be truncated at point 824. All attachments, including contact 802 to rod 820 at point 824, rod 820 to feedthrough conductor 810(A) at point 822, and getter ring 826 to the end of rod 820, may be made by one or more of laser welds, spot welds, and brazing FIGS. 16 and 17 show two-point sprung anode contact 802 of FIG. 15 in further detail. Contact 802 is formed of a semi-circular spring 842 with dimples 844 and 846. Dimples 844 and 846 are outwardly pushed (as indicated by arrows 848 and 849, respectively) with respect to curvature of spring 842, and are substantially diametrically opposed when configured within a neck of a light emitting device (e.g., light emitting device 770, FIG. 11) to contact an anode layer therein. Each of rod 820 and spring 842, and hence two-point sprung anode contact 802, may be made of stainless steel and/or nickel, molybdenum, and other vacuum-compatible metals with a suitable spring constant and good electrical conductivity. In an embodiment, the spring 842 may be made of Inconel® 750X or similar alloy.

FIG. 11 shows one exemplary light emitting device 770 incorporating the two-point sprung anode contact 802 of FIG. 15. Light emitting device 770 includes a transparent envelope 772 and a base section 794. Transparent envelope 772 is for example glass.

Envelope 772 has a face portion 773 through which light is emitted during operation of light emitting device 770. An inner surface of face portion 773 of enclosure 772 is coated with a phosphor layer 776. Envelope 772 has a glass feedthrough base 780 that is formed with a plurality of feedthrough conductors 810 (not all conductors are shown for clarity of illustration) that pass from the inside to the outside of envelope 772. As shown in FIG. 15, thermionic cathode assembly 804 attaches to internal ends of conductors 810 of base 780 such that conductors 810 support assembly 804. In one example, conductors 810 are approximately 1 mm in diameter. Feedthrough base 780 may be formed together with assembly 804 prior to joining with enclosure 772.

Two-point sprung anode contact 802, 788 is shown electrically contacting, at position 798, a mirror anode 774 formed within envelope 772 over phosphor layer 776 and towards a neck 790 of envelope 772. More particularly, two-point sprung anode contact 802, 788 is compressed, inserted into neck 790 and the compression released such that dimples 844 and 846 of anode contact 802, 788 touch a painted graphite ring (i.e., a DAG ring formed with a water-based graphite paint, known in the art) painted around the inside of neck 790, including at position 798.

Base section 794 provides electrical connectivity (shown as an Edison thread in this example) to an external source of electricity and may include one or more circuits 796 (e.g., power converters) for supplying appropriate potentials to two-point sprung contact 802, 788 and assembly 804, and thereby operating light emitting device 770 to produce light.

Of note, contact 802, 788 is substantially perpendicular to neck 790 and rod 820 and provides mechanical support to rod 820 with respect to neck 790. Contact 802 has only two, diametrically opposed, contacts (i.e., at dimples 844, 846) with neck 790 and requires substantially no force from rod 820 to maintain contact with anode 774. When getter ring 826, 786 is included, rod 820 is bent such that getter ring 826, 786 positions the getter material (e.g., an evaporable barium getter material) out of the line of flight of electrons emitted from assembly 804 towards phosphor layer 776. This configuration also allows the getter material to be evaporated against walls of envelope 772 and thereby isolates the getter evaporant away from other interior parts of device 770 where it could potentially cause unwanted side-effects, such as electrical shorts.

The use of two-point sprung contact 802 within light emitting device 770 is believed to be unique for at least the following reasons. Spring 842 is substantially perpendicular to the axis of neck 790. The force applied by spring 842 against enclosure 772 is substantially derived from spring 842 such that spring 842 holds its position within device 770 without creating forces on rod 820 or feedthrough conductor 810(A) (or any other conductor 810 or part of assembly 804). However, spring 842 does maintain position of rod 820 (and optional getter ring 826) within envelope 772. This allows rod 820 and spring 842 to be configured within device 770 as far as possible from an electron source of assembly 804, thereby aiding in avoiding arc-shorts where potential differences are greatest (i.e., between cathode and the anode which derives its potential from two-point strung anode contact 802) and also avoids unwanted electric fields that might distort the flood electrons; trajectories from assembly 804 towards phosphor layer 776.

The two-point sprung anode contact 802 and getter ring 826 (when included) are highly suitable to large-scale manufacturing by being simple, low cost, robust, and reliable. Optionally, graphite (not shown) may be applied to envelope 772 at position 798 to ensure good contact between two-point sprung anode contact 802 and anode 774.

Figure 18:
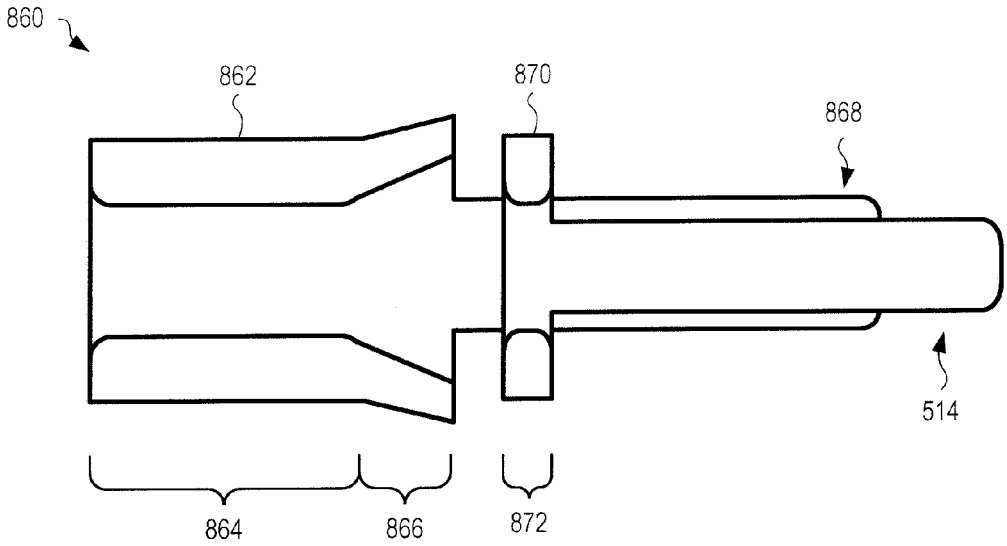
FIG. 18 is a schematic view of an insertion tool for inserting the two-point sprung anode contact of FIGS. 15, 16 and 17*into* the light emitting device of FIG. 18.
Figure 19:
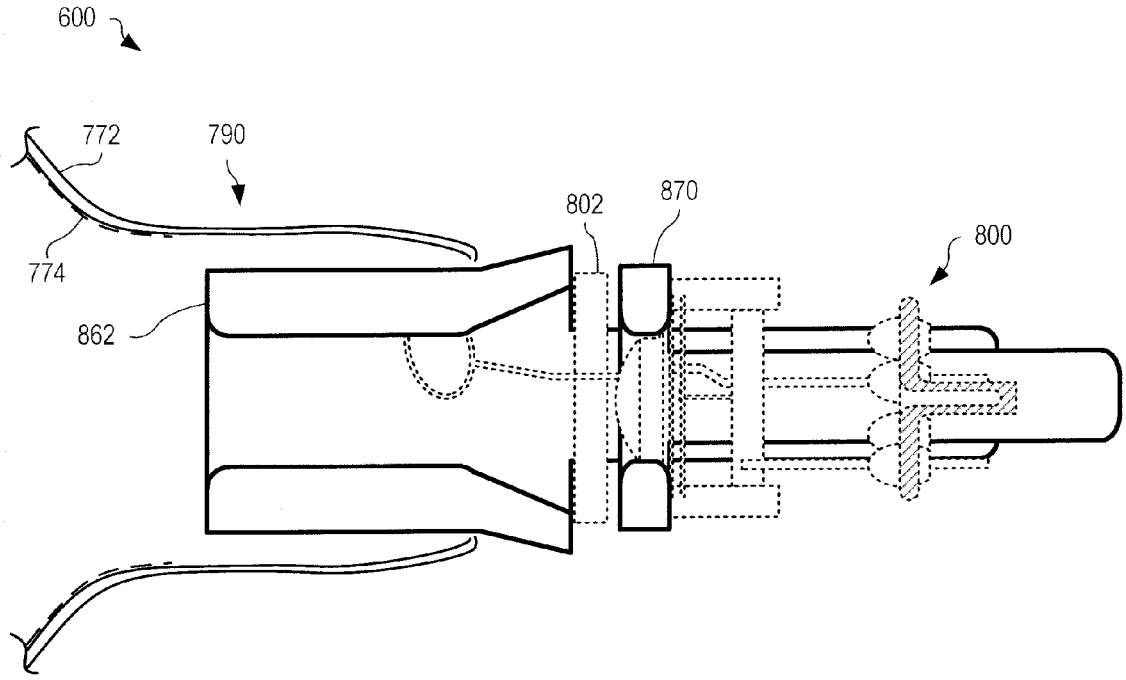
FIG. 19 is a schematic view showing insertion of the two-point sprung anode contact of FIGS. 15, 16 and 17 together with the glass base of FIG. 15 into the light emitting device of FIG. 18, with the insertion tool of FIG. 19.

FIG. 18 shows one exemplary insertion tool 860 for inserting two-point sprung anode contact 802 (and optional getting ring) into neck 790 of envelope 772 without damaging either glass envelope 772 (e.g., by scraping two-point sprung anode contact 802 through neck 790 and leaving potential arc tracks) or two-point sprung anode contact 802 or supporting rod 820. FIG. 19 shows exemplary operation of insertion tool 860 inserting two-point sprung anode contact 802 into neck 790 of envelope 772. FIGS. 18 and 19 are best viewed together with the following description.

Tool 860 includes a compression tube 862 and a plunger 870. Compression tube 862 has a front portion 864 that has a smaller diameter than neck 790 of envelope 772 and thereby allows insertion of compression tube 862 into neck 790 as shown in FIG. 19. Compression tube 862 also has a tapered section 866 and a handle 868. Tapered section 866 ranges in diameter from the diameter of front section 864 to a diameter greater than two-point sprung anode contact 802 (when not compressed). Plunger 870 has a front section 872 and a handle 874. Front section 872 has a diameter substantially the same as the diameter of two-point sprung anode contact 802 and may be sprung such that as it is inserted into tapered section 866 of compression tube 862 front section shrinks to into compression tube 862.

As shown in FIG. 19, multi-form assembly 800 is positioned in alignment with compression tube 862 and with plunger 870 positioned behind two-point sprung anode contact 802. Plunger 870 may include additional support for assembly 800 without departing from the scope hereof. As plunger 870 is advanced towards compression tube 862, two-point sprung anode contact 802 is compressed by tapered section 866. Plunger 870 continues to advance until two-point sprung anode contact 802 is pushed clear of front section 864 and is allowed to expand within envelope 772 to contact anode 774, whereupon insertion tool 860 is removed to leave two-point sprung anode contact 802 (and assembly 800) positioned within neck 790 of envelope 772.

Since front section 872 of plunger 870 is sprung and substantially the same diameter and shape as two-point sprung anode contact 802, minimal force is exerted onto rod 820 during compression and insertion of two-point sprung anode contact 802 into neck 790.

Figure 20:
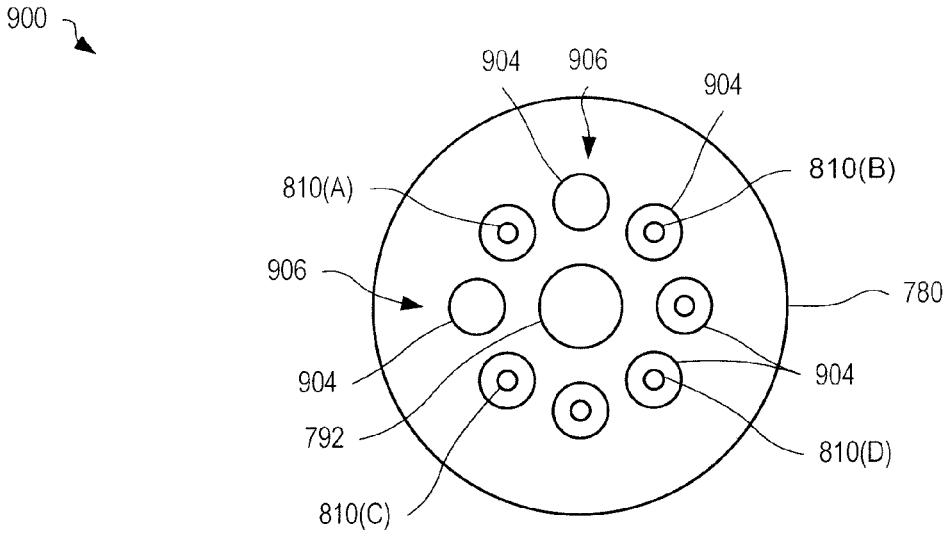
FIG. 20 shows a plan view of the glass base of FIG. 15 in an embodiment.
Figure 21:
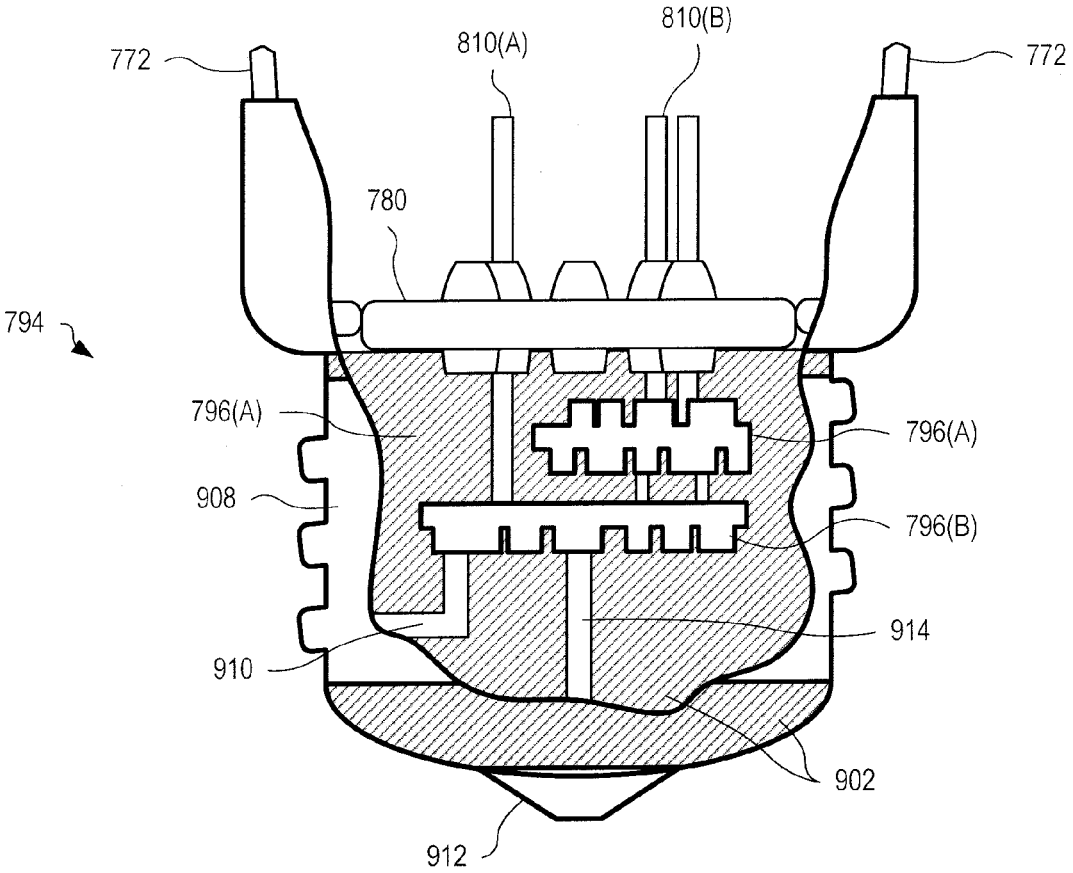
FIG. 21 shows a cut-away view of the base portion of an assembled device with the tube and power supply assemblies of FIG. 11 joined together.

FIG. 20 shows one exemplary plan view 900 of glass base 780 of FIG. 11. FIG. 21 shows a cut-away view of base section 794 of FIG. 11 joined with glass base 780 of FIG. 11. FIGS. 20 and 21 are best viewed together with the following description and with reference to FIG. 11.

Glass base 780 is shown with eight feedthrough positions as indicated by applied support glass bumps 904 that are symmetrically spaced around evacuation tube 792. Six of the eight positions each support one of feedthrough conductors 810. Other spacing may be used without departing from the scope hereof. In particular, conductor 810(A) provides electrical connectivity to mirror anode 774, FIG. 11, conductor 810(B) provides electrical connectivity to heater bar 746, FIG. 10, conductor 810(C) provides electrical connectivity to heater bar 744, and conductor 810(D) provides electrical connectivity to metal field-forming ring 736, FIG. 10. As shown, adjacent to conductor 810(A) are two non-filled locations 906 that provide optimum isolation of conductor 810(A) from the very large negative potentials of other conductors 810. More specifically, by spacing components of highest potential difference as far apart as is practical within light emitting device 770, maximum dielectric isolation in glass base 780 is obtained and reliability of light emitting device 770 is ensured.

In FIG. 21, base section 794 is shown with exemplary circuits 796(A) and 796(B) that each connect to certain of conductors 810. Circuits 796 may be shaped to fit within base section 794 and connect with appropriate conductors 810. Circuit 796(B) provides a potential for mirror anode 774 via conductor 810(A) and provides conditioned electrical power to circuit 796(A), which provides appropriate potentials for metal guard ring 732, metal extraction ring 734, metal field-forming ring 736, metal support ring 738, metal grid 740, and heater bars 744 and 746. More specifically, circuit 796(A) provides a current (e.g., direct, alternating, or pulsed) through the heating element 707 of thermionic flood-emission cathode 700 to heat substrate 702. Circuit 796(B) is coupled to an outer ground ring 908 of the Edison base by a conductor 910, and to a central hot contact 912 of the Edison base by another conductor 914

As shown in FIG. 21, space within base section 794 is filled with a dielectric potting material 902, thereby maximizing robustness and dielectric isolation within base section 794.

Within light emitting device 770, an acceleration voltage of approximately fifteen thousand volts is applied by the power supply circuits 796(A) and 796(B) between mirror anode 744 and cathode 700, with the cathode 700 negative with respect to anode 744.

In an embodiment of light emitting device 770, cathode 700 operates at highly-negative acceleration voltages, typically on the order of sixteen thousand volts, and mirror anode 774 is at ground potential. This mode of operation eliminates electrostatic attraction (of dust, etc.) to the outside of the lamp because there is no potential drop, nor electric field, proximate to the surface of envelope 772 or base section 794. This configuration also allows for solid, reliable positioning of electron gun or multiform assembly 730 directly on feedthrough conductors 810 of glass base 780, thereby lowering manufacturing costs by increasing throughput, maximizing robustness and reliability of light emitting device 770, and allowing for maximum dielectric isolation within glass base 780.

In an alternative embodiment, in order to simplify power supply circuits 796(A) and 796(B), cathode 700 is near ground potential, and anode 744 is held at a positive potential of fifteen thousand volts. In this embodiment, an optional transparent conductive layer, such as a thin layer of indium tin oxide, may be applied to an exterior surface of the face 773 of the envelope to bleed off static charges accumulating thereon and avoid undue accumulation of dust and dirt. In embodiments having a transparent conductive layer on an exterior of the face, this layer may be coupled to a ground connection at the base section 794 through DAG or conductive paint on the outside of the envelope. The DAG or conductive paint is preferably highly resistive to reduce any shock hazards should a lighting fixture into which the lighting device 770 is inserted have been mistakenly wired with the shell of the Edison socket connected to a hot wire instead of neutral.

Heater bars 744 and 746 provide electrical connectivity between conductors 810(B), 810(C) and wire portions 136(A), 136(B), respectively. Further, as shown in FIG. 10, heater bars 744 and 746 provide rigid support for dielectric attachment bars 140(A) and 140(B) and thus metal guard ring 740, metal extraction ring 736 and its attached metal support ring 738 and metal grid 740. Heater bars 744 and 746 thereby also allow direct attachment of multiform assembly 730 (electron gun) and base section 794 to feedthrough conductors 810 of glass base 780.

This attachment method is not believed to have been used in any other vacuum device. Specifically, feedthrough conductors 810 are larger (e.g., 1 mm diameter, and may be in a range of 0.5 mm to 2 mm in diameter) than typically used for similar sized lighting devices to provide enough rigidity such that heater bars 744 and 746 are directly attached thereto by spot or laser welding. This eliminates wiring within light emitting device 770. Thus, heater bars 744, 746 provide two mechanical supports and a third support is provided by conductor 810(D) attaching to metal field forming ring 736. This method of attaching multiform assembly 730 to feedthrough conductors 810 of glass base 780 allows for greater rigidity and robustness of the internal parts of light emitting device 770. This attachment method minimizes the overall length of light emitting device 770 and simplifies the manufacturing process, increases operational reliability, lends to high-volume manufacturing throughput, and lowers the cost.

This method of attaching multiform assembly 730 to feedthrough conductors 810 of glass base 780 also allows for isolation of all the low-voltage feedthrough conductors (which typically operate at negative kV values) to positions of furthest spacing from feedthrough conductors 810 connecting to mirror anode 774, which also has its feedthrough conductor 810(A) in the same glass base. Such isolation of conductors 810 with great potential differences substantially increases reliability of light emitting device 770 by averting potential electrical arcs between these feedthrough conductors and minimizes any electric field within glass base 780 to minimize the danger of electromigration within glass base 780.

This attachment method, and feedthrough conductor configuration, also allows for judicious isolation of the low-voltage signals from all external surfaces of light emitting device 770. Such ability to isolate the kV signals allows for substantial safety assurance for users of light emitting device 770. It also prevents forming any significant electric fields between the low-voltage signals and the grounded exterior of the lamp. Such field prevention is important to eliminate dust, eliminate electrostatic attraction of ambient insects (or moisture, or ionized materials or debris, etc.) and eliminate glass failures through electromigration in envelope 772.

The use of thicker feedthrough conductors 810 on glass base 780 works well with automated equipment that is useful for high-volume manufacturing. The clustering of all feedthrough conductors 810 close to evacuation tube 792 allows all of the (kV-range) low voltages components (e.g., circuits 796) to be safely sealed into potting material 902 in base section 794. As with the interior spacing of conductor 810(A) from conductor 810(D) (i.e., anode to cathode potentials), the same spacing occurs on the exterior of glass base 780 to facilitate dielectric isolation of the significantly-differing voltages, and thus prevents arc-discharge or plasma formation exterior of glass base 780. It also protects the consumer by facilitating completely insulated electronics and interconnects.

Direct mounted electron source 730 is suitable to large-scale manufacturing by being very simple, low cost, robust, and very reliable. Although glass base 780 is shown with eight feedthrough conductors 810 in the above examples, more or fewer feedthrough conductors 810 may be used without departing from the scope hereof.

For purposes of this document, transparent means that visible light can pass through the object, and includes objects generally known as both translucent and transparent.

Changes may be made in the above methods and systems without departing from the scope hereof. It should thus be noted that the matter contained in the above description or shown in the accompanying drawings should be interpreted as illustrative and not in a limiting sense. The following claims are intended to cover all generic and specific features described herein, as well as all statements of the scope of the present method and system, which, as a matter of language, might be said to fall there between.

What is claimed is:

1. A cathodoluminescent device comprising:

a transparent envelope;

a reflective, conductive, metal anode layer deposited over a phosphor layer deposited on an interior of a face of the envelope;

a thermionic, broad-beam, electron gun attached to feedthroughs penetrating a glass disk, the glass disk fused to a base of the envelope, the electron gun comprising a cathode, a metal guard ring, a metal extraction ring, a metal field-forming ring, and a diffusing grid, and wherein the cathode further comprises a heater;

a two point snubber making contact to the anode layer, the snubber coupled to a feedthrough of the glass disk; and a power supply mounted to the feedthroughs of the glass disk, the power supply having circuitry for providing power to the heater of the cathode and for providing an acceleration voltage between the electron gun and the anode, the power supply having a connector for coupling the device to receive power from a fixture.

2. The cathodoluminescent lighting device of claim 1 wherein the metal anode layer is in the range of approximately sixty to ninety nanometers thick where the anode layer lies over the phosphor layer.

3. The cathodoluminescent lighting device of claim 1 wherein the electron gun is driven negative with respect to a ground voltage applied to the anode layer, and where ground is contact of the connector for coupling the device to receive power from a fixture.

4. The cathodoluminescent lighting device of claim 1 wherein the anode is driven positive with respect to a ground voltage applied to the an element of the electron gun, and where the device further comprises a transparent conductive layer on the face of the envelope to bleed off static charges developing thereon.

5. A method of manufacturing an anode for a cathodoluminescent lighting device, comprising:

coating an inside surface of a face of an envelope with a phosphor layer;

applying a lacquer layer to an inside surface of the phosphor layer;

depositing a layer of aluminum on a spiral tungsten filament;

inserting the spiral tungsten filament into the envelope at a predetermined position;

applying a vacuum to the filament and the envelope;

preheating the filament to a first temperature, the first temperature near but above a melting temperature of the aluminum;

rapidly heating the filament to a second temperature, the second temperature considerably above a melting temperature of the aluminum;

holding the filament at the second temperature for a predetermined time;

allowing the filament to cool;

removing the filament from the envelope and admitting oxidizing atmosphere to the envelope;

heating the envelope to burn off the lacquer; and cooling the envelope.

6. The method of claim 5 wherein the step of depositing a layer of aluminum on the spiral tungsten filament is performed by thermal spray coating.

7. The method of claim 5 wherein the step of depositing a layer of aluminum on the spiral tungsten filament is performed by placing a foil over the filament and heating the filament.

8. The method of claim 5 wherein the step of heating the envelope to burn off excess lacquer is performed by heating the envelope to a temperature of approximately four hundred fifty degrees Celsius.

9. The method of claim 5 wherein the coating of an inside surface of the envelope with a phosphor layer and the applying of lacquer to the inside surface of the phosphor layer are performed by preparing a slurry, the slurry comprising cathodoluminescent phosphor suspended in a first solvent with dissolved potassium silicate;

placing the slurry and a cushion solution upon a face of the envelope;

allowing at least part of the cathodoluminescent phosphor to settle on the face of the envelope to form a phosphor layer;

preparing a lacquer in a second solvent, the second solvent having specific gravity less than specific gravity of the first solvent;

floating an aliquot of the prepared lacquer on the slurry;

withdrawing the first solvent to allow the lacquer to settle on the phosphor layer; and baking the envelope to expel the first solvent and the second solvent from the phosphor layer and the lacquer layer.

10. The method of claim 9 wherein the step of depositing a layer of aluminum on the spiral tungsten filament is performed by thermal spray coating.

11. The method of claim 9 wherein the step of depositing a layer of aluminum on the spiral tungsten filament is performed by placing a foil over the filament and heating the filament.

12. A method of manufacturing an anode for a cathodoluminescent lighting device comprising:

coating an inside surface of a face of an envelope with a phosphor layer;

applying a lacquer layer to an inside surface of the phosphor layer;

depositing a layer of aluminum on a spiral tungsten filament, the spiral filament having a conical shape having an apex and a base;

inserting the spiral tungsten filament into the envelope at a predetermined position with the apex of the filament closer to the phosphor layer than the base of the filament;

applying a vacuum to the filament and envelope;

preheating the filament to a first temperature, the first temperature near but above a melting temperature of the aluminum;

rapidly heating the filament to a second temperature, the second temperature considerably above a melting temperature of the aluminum;

holding the filament at the second temperature for a predetermined time;

allowing the filament to cool;

removing the filament from the envelope and ventilating to atmospheric pressure;

heating the envelope in oxidizing atmosphere to burn off the lacquer; and cooling the envelope.

13. The method of claim 12 wherein the conical shape of the filament has an angle between sides of the conical shape and an axis of the conical shape of between five and forty-five degrees.

14. The method of claim 13 wherein the conical shape of the filament has an angle between sides of the conical shape and an axis of the conical shape of approximately ten degrees.

15. The method of claim 14 wherein depositing a layer of aluminum on the filament is performed by thermal spray coating.

16. The method of claim 14 wherein the filament has a nonuniform winding pitch such that a pitch at the base of the filament is greater than a pitch at the apex of the filament.

17. The method of claim 12 wherein the coating of an inside surface of the envelope with a phosphor layer and the applying of lacquer to the inside surface of the phosphor layer are performed by:

preparing a slurry, the slurry comprising cathodoluminescent phosphor suspended in a first solvent with dissolved potassium silicate;

placing the slurry and a cushion solution upon a face of the envelope;

allowing at least part of the cathodoluminescent phosphor to settle on the face of the envelope to form a phosphor layer;

preparing a lacquer in a second solvent, the second solvent having specific gravity less than specific gravity of the first solvent;

floating an aliquot of the prepared lacquer on the slurry;

withdrawing the first solvent to allow the lacquer to settle on the phosphor layer; and baking the envelope to expel the first solvent and the second solvent from the phosphor layer and the lacquer layer.

18. A two-point sprung anode contact for use in a light emitting device having an enclosure with a neck portion, an electron source and an anode layer formed therein, comprising:

a substantially semi-circular spring that is conductive of electricity and has two outwardly protruding and diametrically opposed contacts;

an electrically conductive rod attaching to the spring, for positioning the spring within and substantially perpendicular to the axis of the neck to contact the anode layer, the rod electrically connecting the spring to a feedthrough conductor of the light emitting device.

19. The contact of claim 18, wherein the spring imparts opposing forces to the contacts to contact the anode layer, the opposing forces driving substantially from the spring and not the rod.

20. The contact of claim 18, the spring and the rod each comprising one of stainless steel, molybdenum and nickel.

21. The contact of claim 18, the spring being formed as a curled strip.

22. The contact of claim 21, the contacts being formed as outwardly protruding dimples at each end of the curled strip.

23. The contact of claim 18, the spring being formed as a curled rod, the contacts being formed by kinks in the rod.

24. The contact of claim 18, further comprising a getter ring for positioning a getter material within the light emitting device, the getter ring connecting to a portion of the rod that extends beyond the spring, the portion of the rod being bent to position the getter ring away from the flight path of electrons impacting the anode layer.

25. A method for inserting a two-point sprung anode contact within a neck of an envelope of a light emitting device, comprising:

compressing the two-point sprung anode contact to a diameter smaller than the internal diameter of the neck;

positioning the two-point sprung anode contact within the neck; and decompressing the two-point sprung anode contact such that it expands to contact the neck.

26. The method of claim 25, the step of compressing comprising compressing the two-point sprung anode contact without imparting any significant force onto a supporting rod of the two-point sprung anode contact.

27. The method of claim 25, wherein no forces are applied to the neck and envelope during the steps of compressing and positioning.

28. A light emitting device, comprising:

an evacuated envelope having a face portion for emitting light and a neck;

a phosphor layer coating an inside surface of the face portion;

an electron source within the neck for emitting electrons towards the phosphor layer;

an anode layer within the evacuated envelope, covering the face portion and extending towards the neck;

a two-point sprung anode contact comprising:

a substantially semi-circular spring that is conductive of electricity and has two outwardly protruding and diametrically opposed contacts; and a rod attaching to the spring, for positioning the spring within and substantially perpendicular to the axis of the neck, the diametrically opposed contacts connecting with the anode layer; and a plurality of feedthrough conductors that pass through the enclosure to provide electrical connectivity to the electron source and the anode layer via the rod and the two-point sprung anode contact.

29. The light emitting device of claim 28, the two-point sprung anode contact applying outward force to the diametrically opposed contacts to maintain a position of the spring within the neck, the rod applying no force to maintain the position of the spring within the neck.

30. The emitting device of claim 28, the two-point sprung anode contact comprising one or more of stainless steel, molybdenum and nickel.

31. The electron source of claim 28, the two-point sprung anode contact further comprising a getter ring positioned at an end of the rod opposite the feedthrough conductors, the getter ring positioning a getter material substantially outside the flight path of electrons emitted from the electron source towards the phosphor layer.

32. The electron source of claim 28, wherein the first and second dielectric attachment bars each comprise one of glass and ceramic.

33. A direct-mount electron source for use in a light emitting device having an enclosure with a neck portion and an anode layer formed therein, comprising:

a glass base having a plurality of feedthrough conductors;

an electron source comprising:

a thermionic flood-emission cathode electrically connected to a first of the plurality of feedthrough conductors;

a first metal heater bar attached to a first end of a heating element of the thermionic flood-emission cathode, the first heater bar being directly attached to a second of the plurality of feedthrough conductors;

a second metal heater bar attached to a second end of the heating element, the second heater bar attached to a third of the plurality of feedthrough conductors;

a metal extraction ring aligned with an emissive surface of the thermionic flood-emission cathode, the metal extraction ring being electrically connected to a fourth of the plurality of feedthrough conductors;

a metal field-forming ring aligned with the metal extraction ring and positioned further from the emissive surface than the metal extraction ring, the metal field-forming ring being electrically connected to a fifth of the plurality of feedthrough conductors;

a metal grid having a substantially convex shape and a substantially uniform distance from the emissive surface, the metal grid being positioned further from the emissive material than the metal field-forming ring;

a metal support ring, attached to the metal field-forming ring, for supporting the metal grid and electrically connecting the metal grid to the metal field-forming ring; and first and second dielectric attachment bars positioned on opposite sides of the first and second heater bars, the metal extraction ring, and the metal field-forming ring, to hold the first and second heater bars, the metal extraction ring, and the metal field-forming ring in position relative to one another; and a two-point anode contact electrically connected to a sixth of the plurality of feedthrough conductors by a rod.

34. The electron source of claim 33, wherein the first metal heater bar, the second metal heater bar, the metal extraction ring, the metal field-forming ring, the metal grid, and the metal support ring each comprise one of stainless steel, molybdenum and nickel.

35. The electron source of claim 33, the metal extraction ring being directly connected to the fourth of the plurality of feedthrough conductors.

36. The electron source of claim 33, metal field-forming ring being directly connected to the fifth of the plurality of feedthrough conductors.

37. The electron source of claim 33, further comprising a metal guard ring substantially aligned with the emissive surface and positioned between the emissive surface and the metal extraction ring, the metal guard ring being electrically connected to the first of the plurality of feedthrough conductors.

38. The electron source of claim 33, wherein the potential of the two-point anode contact is substantially ground.

39. The electron source of claim 33, further comprising a getter ring for positioning a getter material within the light emitting device, the getter ring connecting to a portion of the rod that extends beyond the two-point anode contact, the rod being bent to position the getter ring away from the flight path of electrons emitted from the electron source.

40. A light emitting device, comprising:

a glass base having a plurality of feedthrough conductors;

a cathode comprising:

a heating element;

a substrate having a first surface attached to the heating element and a second surface opposite the first surface; and an emissive material formed on the second surface;

an electron source comprising:

first and second metal heater bars for electrically connecting to and supporting the heating element, the first metal heater bar being directly connected to a first of the plurality of feedthrough conductors, and the second metal heater bar being directly connected to a second of the plurality of feedthrough conductors;

a metal extraction ring aligned with the emissive material and electrically connected to a third of the plurality of feedthrough conductors;

a metal field-forming ring aligned with the metal extraction ring and positioned further from the emissive material than the extraction ring, the metal extraction ring being electrically connected to a fourth of the plurality of feedthrough conductors;

a metal grid having a substantially convex shape and a substantially uniform distance from the emissive material, the metal grid being positioned further from the emissive material than the metal field-forming ring;

a metal support ring attached to the metal field-forming ring and supporting the metal grid, the metal support ring electrically connecting the metal field-forming ring and the metal grid; and first and second dielectric attachment bars for supporting the first and second heater bars, the metal extraction ring, and the metal field-forming ring; and a transparent envelope forming an evacuated enclosure for containing the electron source, the transparent envelope having an anode formed on an inner front face of the envelope and a plurality of electrical feeds that pass through the envelope to connect to and support the electron source and to connect to the anode.

41. The light emitting device of claim 40, the electron source further comprising a metal guard ring substantially aligned with the emissive material and positioned between the emissive material and the metal extraction ring, the metal guard ring being supported by the first and second dielectric attachment bars.

42. The emitting device of claim 41, wherein the metal guard ring comprises a material selected from the group consisting of stainless steel, molybdenum and nickel.

43. The electron source of claim 40, wherein the first metal heater bar, the second metal heater bar, the metal extraction ring, the metal field-forming ring, the metal grid, and the metal support ring each comprise one of stainless steel, molybdenum and nickel.

44. The electron source of claim 40, wherein the first and second dielectric attachment bars each comprise one of glass and ceramic.

* * * * *

UNITED STATES PATENT AND TRADEMARK OFFICE

CERTIFICATE OF CORRECTION

PATENT NO. : 8,749,127 B2
APPLICATION NO. : 13/262594
DATED : June 10, 2014
INVENTOR(S) : Richard Herring et al.

It is certified that error appears in the above-identified patent and that said Letters Patent is hereby corrected as shown below:

Title Page, item (75), third inventor Name Bernard K. Vanch should be corrected to read:
Bernard K. Vancil Signed and Sealed this
Twenty-sixth Day of August, 2014

Michelle K. Lee

Michelle K. Lee
*Deputy Director of the United States Patent and Trademark Office*